US012691363B2

(12) United States Patent
Misaki et al.

(10) Patent No.: US 12,691,363 B2
(45) Date of Patent: Jul. 28, 2026

(54) GAME EQUIPMENT

(71) Applicant: TOMY COMPANY, LTD., Tokyo (JP)

(72) Inventors: Yuki Misaki, Tokyo (JP); Hideyuki Kato, Tokyo (JP); Makoto Tokunaga, Tokyo (JP); Fujio Nobata, Tokyo (JP); Tommy Lai, Kowloon Bay (HK); Haruna Komori, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 225 days.

(21) Appl. No.: 18/781,556

(22) Filed: Jul. 23, 2024

(65) Prior Publication Data

US 2025/0205587 A1 Jun. 26, 2025

(30) Foreign Application Priority Data

Dec. 26, 2023 (JP) ..... 2023-219473

(51) Int. Cl.
*A63F 3/00* (2006.01)

(52) U.S. Cl.
CPC ..... *A63F 3/00261* (2013.01); *A63F 3/00697* (2013.01); *A63F 2003/00287* (2013.01); *A63F 2003/00548* (2013.01)

(58) Field of Classification Search
None
See application file for complete search history.

(56) References Cited

U.S. PATENT DOCUMENTS 1,532,069 A * 3/1925 Scalabrini ..... A63F 3/0023 273/260
2,293,298 A * 8/1942 Macdonald ..... A63F 3/00075 D21/337
2,391,147 A * 12/1945 Fredriksson ..... A63F 3/00 273/288
3,004,357 A * 10/1961 Tojza ..... A63F 3/0645 273/237

(Continued)

FOREIGN PATENT DOCUMENTS

DE 8535950 * 2/1986 ..... A63F 9/00
FR 2604073 A1 * 3/1988 ..... A63F 3/00697
JP 4352186 B1 10/2009

*Primary Examiner* — Julie K Brocketti
(74) *Attorney, Agent, or Firm* — IP Business Solutions, LLC.

(57) ABSTRACT

A game equipment includes a track belt unit, a drive unit, and a support unit. The track belt unit is formed in a ring shape. The track belt unit extends in a longitudinal direction. The drive unit rotates the track belt unit. The support unit supports the track belt unit. The track belt unit is wound around the support unit. The track belt unit is away from a floor. The longitudinal direction is parallel to a floor. The track belt unit includes first to third placement squares thereon. The first placement square is configured next to the second placement square in the longitudinal direction. The third placement square is configured next to the first placement square in a short direction perpendicular to the longitudinal direction. The first to third placement squares include respectively first to third holding parts being configured to hold respectively first to third game pieces.

12 Claims, 12 Drawing Sheets

(56) References Cited

U.S. PATENT DOCUMENTS 3,751,039 A * 8/1973 Dykoski ..... A63F 3/02
273/290
3,804,418 A * 4/1974 Sander ..... A63F 3/00261
273/284
4,546,981 A * 10/1985 Elizondo ..... A63F 3/00261
273/284
5,052,691 A * 10/1991 Fernandez Jimenez de Castro ....
A63F 9/0807
273/284

* cited by examiner

Fig. 10
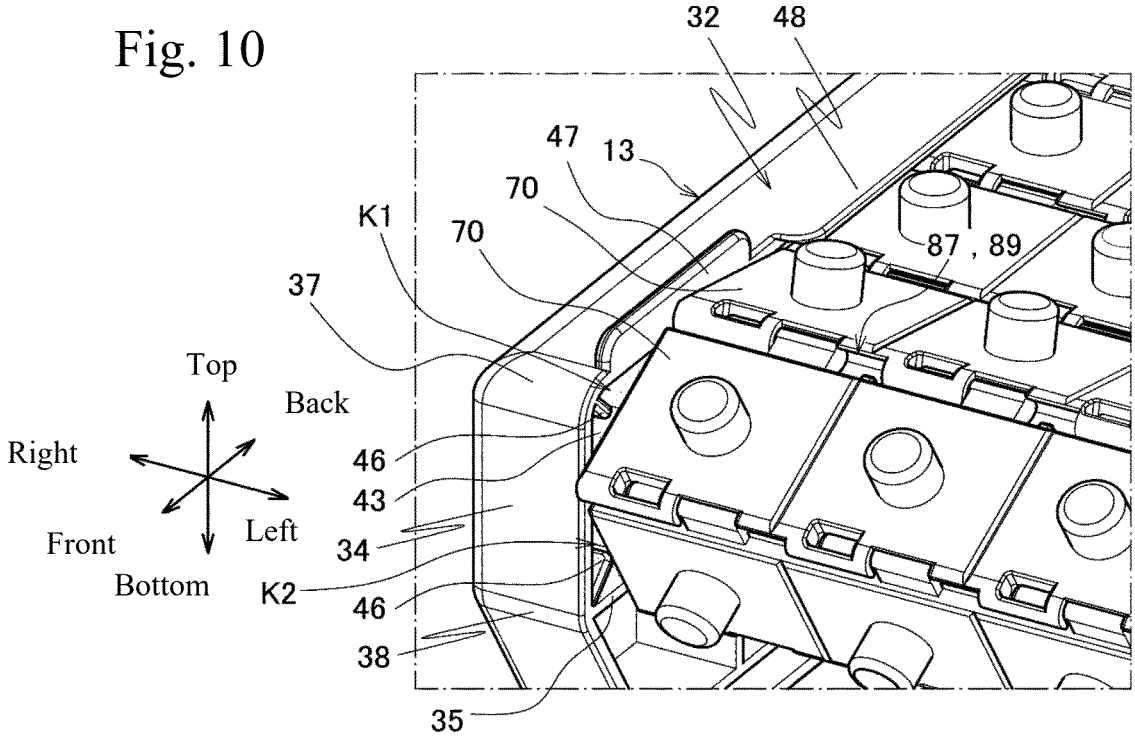
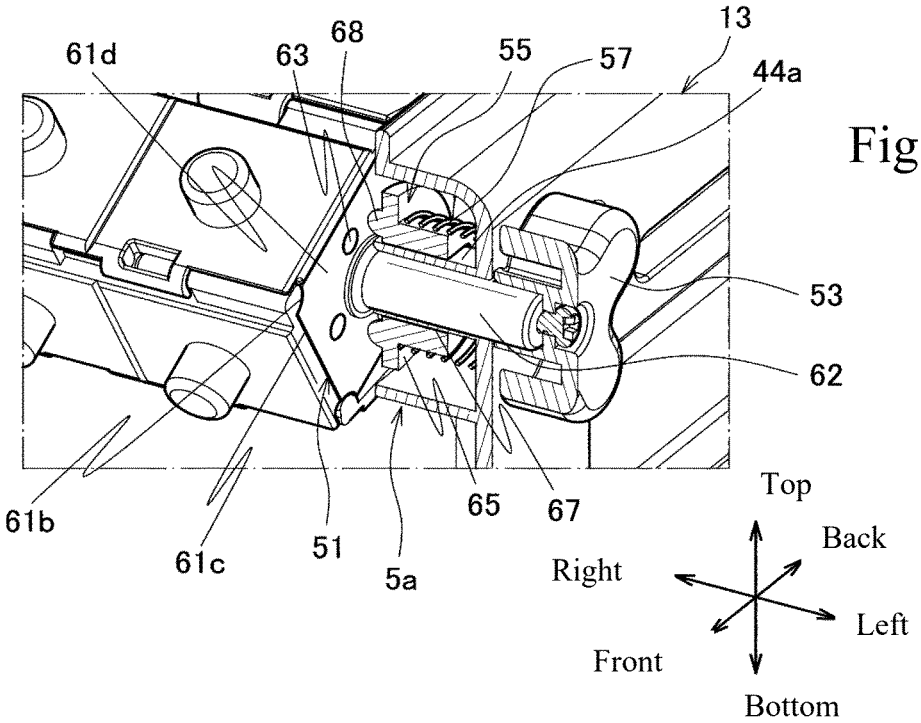
Fig. 11

GAME EQUIPMENT

CROSS-REFERENCE TO THE RELATED APPLICATION

The present application claims priority under 35 U.S.C. 119 to Japanese Patent Application No. 2023-219473 filed on Dec. 26, 2023. The entire content of Japanese Patent Application No. 2023-219473 is incorporated herein by reference.

BACKGROUND

Technical Field

The present invention relates to game equipment.

Background Art

Conventionally, game equipment for playing games such as Shogi and Go in which the outcome is determined by the placement of game pieces has been widely used. Board game equipment has been developed that has a function of dropping game pieces placed on the upper side of the game equipment (Patent Document 1).

Patent Document 1: Japanese Patent Publication No. 4352186

SUMMARY

Problems the Invention Is Intended to Solve

However, in the technology noted in the abovementioned Patent Document 1, game pieces could only be placed on the upper side of the game equipment, so there was room for further improvement.

The present invention was created in consideration of those circumstances, and its purpose is to provide game equipment that can improve gameplay.

Means for Solving the Problems

A game equipment includes a track belt unit, a drive unit, and a support unit. The track belt unit is formed in a ring shape. The track belt unit extends in a longitudinal direction. The drive unit is configured to rotate the track belt unit. The support unit is configured to support the track belt unit. The track belt unit is wound around the support unit. The track belt unit is away from a floor by a prescribed distance, when the track belt unit is wound around the support unit. The longitudinal direction is parallel to a floor when the track belt unit is wound around the support unit. The track belt unit includes first to third placement squares thereon. The first placement square is configured next to the second placement square in the longitudinal direction. The third placement square is configured next to the first placement square in a short direction perpendicular to the longitudinal direction. The first to third placement squares include respectively first to third holding parts being configured to hold respectively first to third game pieces.

BRIEF DESCRIPTION OF THE DRAWINGS

FIG. 10 is an enlarged view of area A in FIG. 8.

FIG. 11 is an enlarged view of area B in FIG. 8.

DETAILED DESCRIPTION OF PREFERRED EMBODIMENTS

Figure 1:
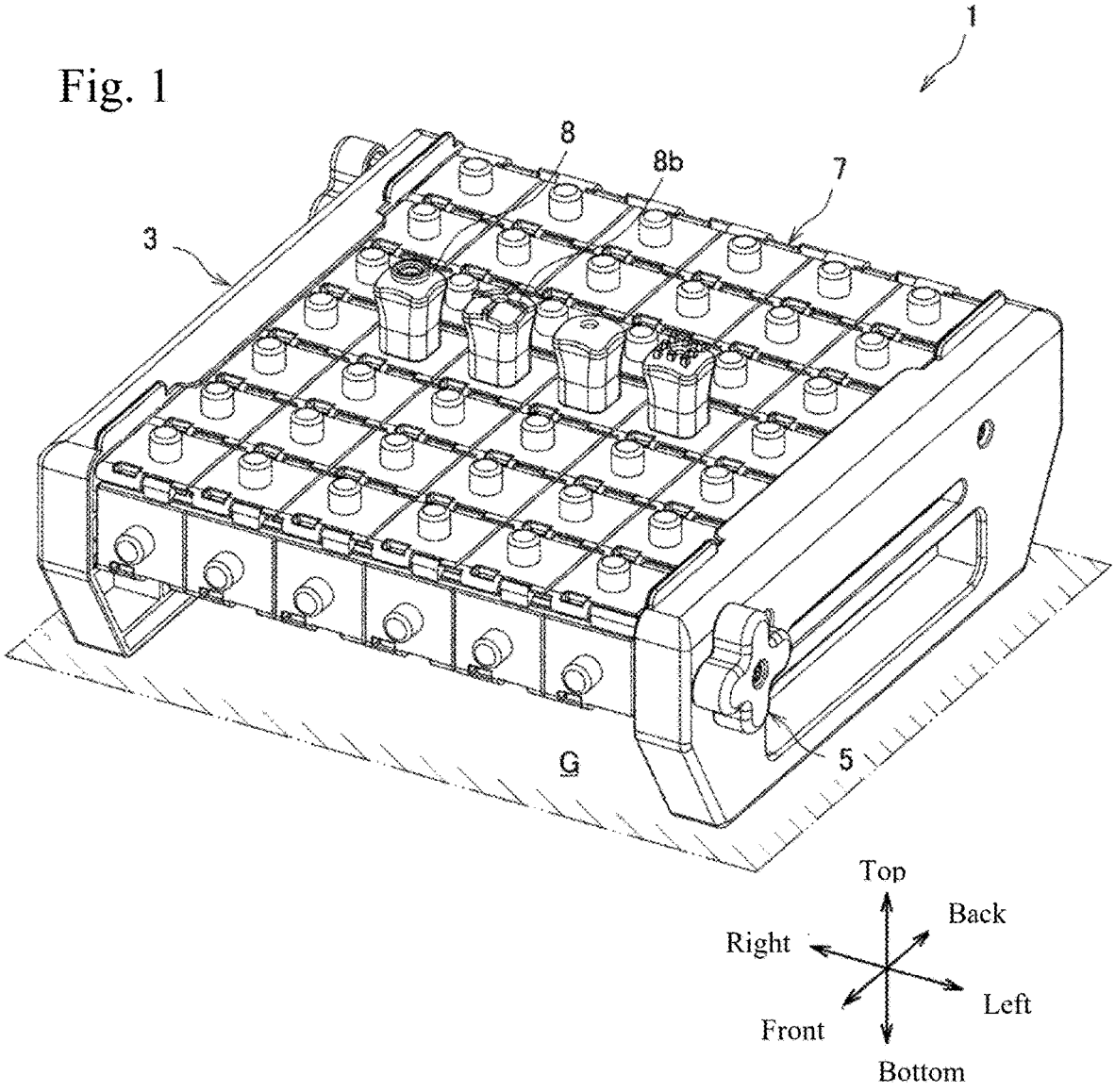
FIG. 1 is a perspective view of a game equipment 1 according to the present invention.

Hereafter, an embodiment of the present invention is explained while referring to the drawings. For convenience of explanation, any direction among horizontal directions will be explained as the front-back direction (first direction or longitudinal direction), the direction perpendicular to the front-back direction among the horizontal directions will be explained as the lateral direction (second direction or short direction), and the direction perpendicular to the horizontal direction will be explained as the vertical direction. The right side in the lateral direction indicates the right hand direction when looking forward from the rear in the front-back direction, and the left side in the lateral direction indicates the left hand direction when looking forward from the rear in the front-back direction.

Figure 2:
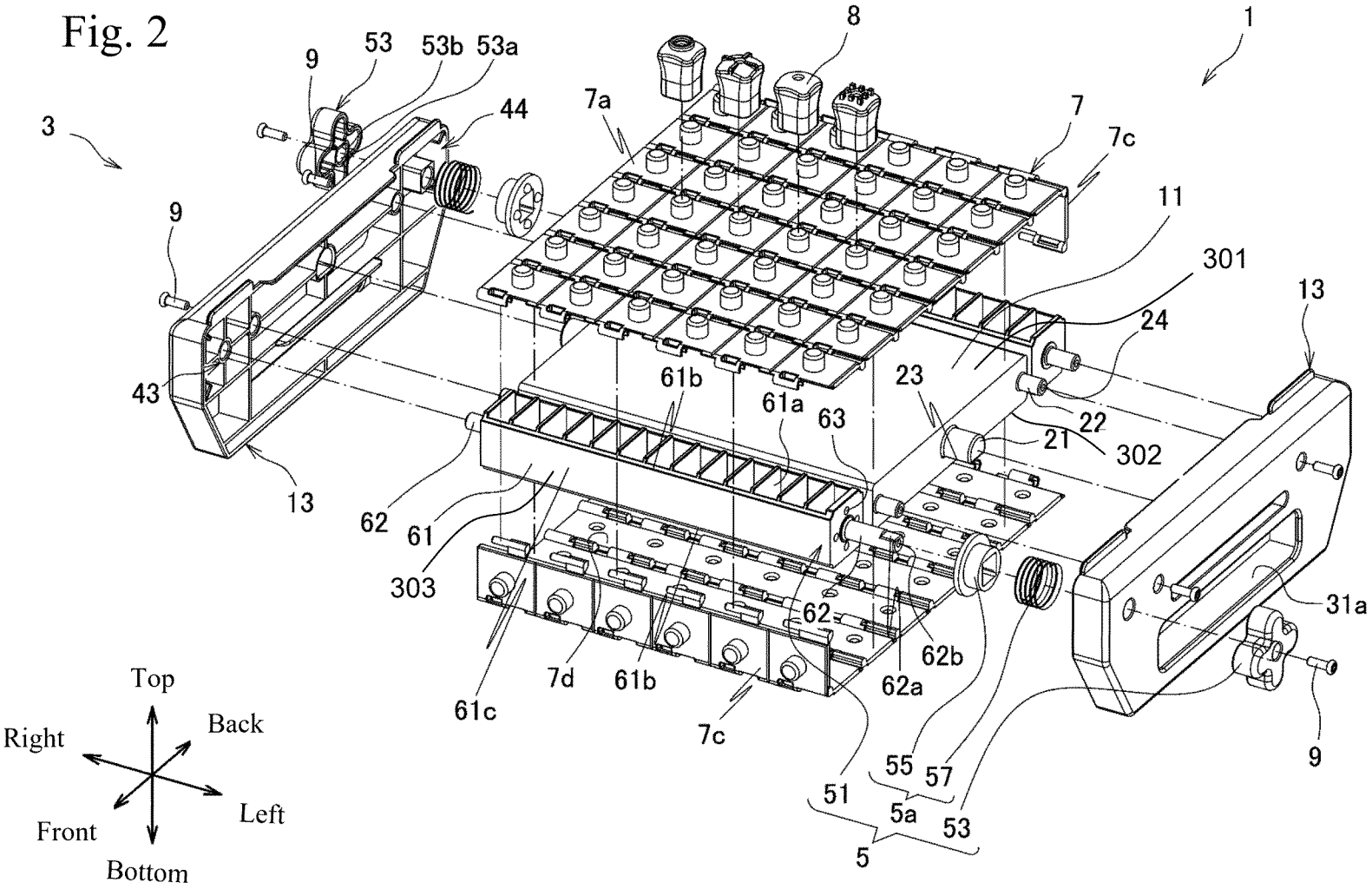
FIG. 2 is an exploded perspective view of the game equipment 1 according to the present invention.

Referring to FIG. 1, a perspective view of the game equipment 1 according to the present invention is shown. Referring to FIG. 2, an exploded perspective view of the game equipment 1 according to the present invention is shown. The game equipment 1 is a tool for playing a game that is placed on a desktop (ground surface G) and is used by a plurality of people using game pieces 8. This game equipment 1 comprises the support unit 3, the drive unit 5, and the track belt unit 7.

The support unit 3 is a support that supports the drive unit 5 and the track belt unit 7. According to FIG. 2, the support unit 3 has a base member 11 and a left-right pair of standing members (cover members) 13. The support unit has a first main surface 301 and a second main surface 302 being opposite to the first main surface. The second main surface faces a floor. The support unit also includes a first side 303 that connects the first and second main surfaces 301, 302. The base member 11 is a housing-shaped member made of resin extending in the horizontal direction. This base member 11 supports the track belt unit 7 to be driveable. The base member 11 has a first pin 21 and a second pin 22 formed respectively at both left and right ends. The first pin 21 is an approximately cylinder-shaped pin extending in the lateral direction from the center in the front-back direction of the base member 11. This first pin 21 has a horizontal surface 23 formed on the bottom end, for example. The second pin 22 is a cylinder-shaped pin extending outward in the lateral direction from two locations on the front-back direction front side and back side of the base member 11. This second pin 22 has a female thread part 24 formed extending inward in the lateral direction from the tip part.

Figure 3:
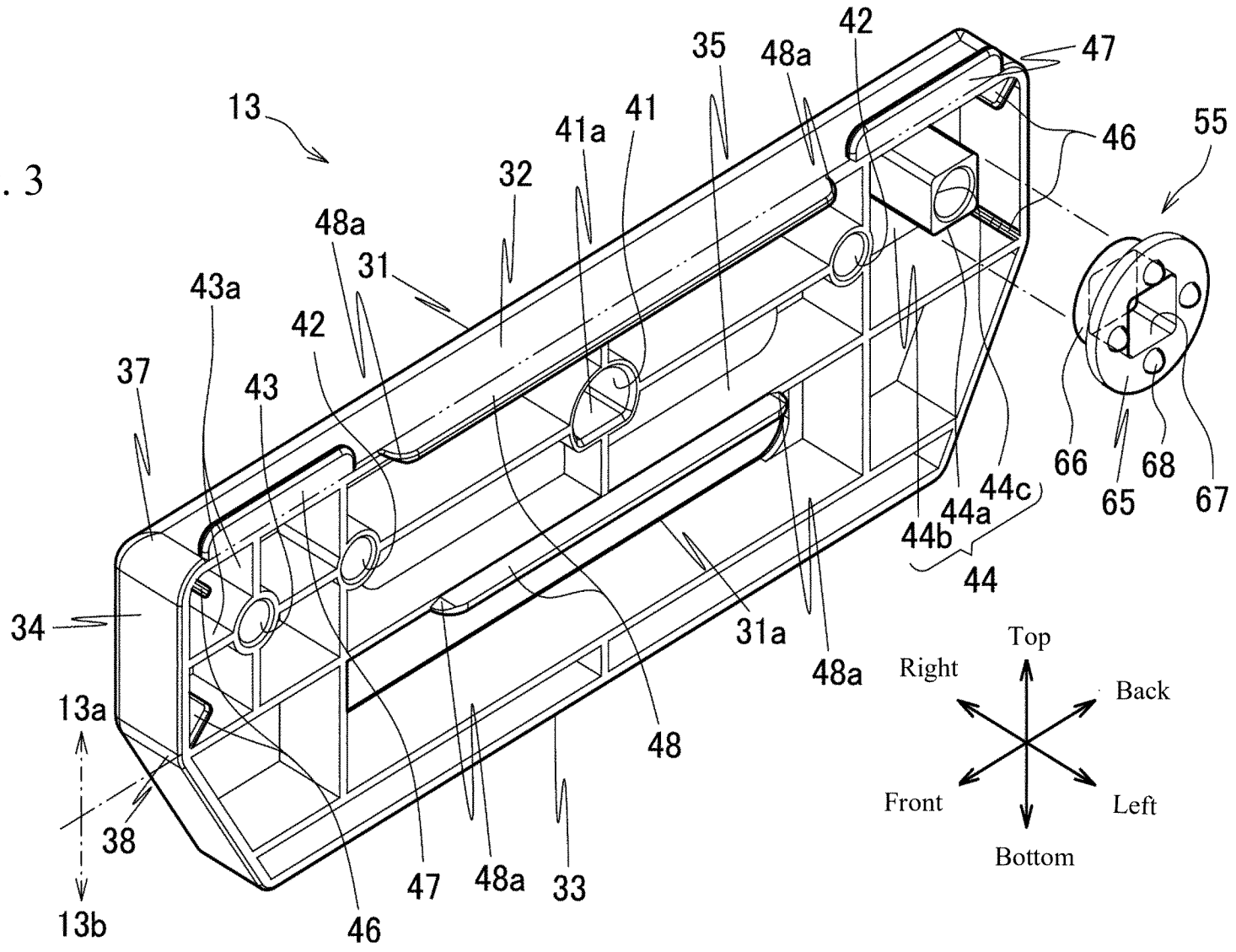
FIG. 3 is a perspective view of a standing member 13 on the right side in the lateral direction in a support unit 3.

Referring to FIG. 3, shown is a perspective view of the standing member 13 on the right side in the lateral direction of the support unit 3. Hereafter, mainly the standing member 13 at the right side in the lateral direction is explained, and the standing member 13 at the left side in the lateral direction is a member of the same shape in the present embodiment, and is an item rotated by 180° with the vertical direction as the axis, so a detailed explanation is omitted. The standing member 13 is a housing-shaped member made of resin extending in the vertical direction and the front-back direction. The standing member 13 also has an upper side cover part 13*a* and a lower side leg part 13*b* from the approximate center in the vertical direction. In specific terms, the standing member 13 is formed with a design wall part 31, an upper wall part 32, a lower wall part 33, a side wall part 34, and an intermediate wall part 35.

The design wall part 31 is a wall part with a design surface formed on the right side in the lateral direction of the standing member 13. This design wall part 31 has a horizontal hole 31*a* formed extending in the front-back direction below the center in the vertical direction. The horizontal hole 31*a* is a hole that penetrates the design wall part 31 in the lateral direction. The upper wall part 32 is a wall part that extends leftward from the top end of the design wall part 31, the lower wall part 33 is a wall part that extends leftward from the bottom end of the design wall part 31, and the side wall part 34 is a wall part that extends leftward from the front-back ends of the design wall part 31. The intermediate wall part 35 is a wall part extending in the front-back direction at approximately the center in the vertical direction of the standing member 13. This intermediate wall part 35 extends leftward from the design wall part 31 the same as the upper wall part 32, etc. The intermediate wall part 35, though described in detail later, is positioned at the lower side of the track belt unit 7. In this way, the standing member 13 has the right side surface formed by the design wall part 31, the upper surface by the upper wall part 32, the lower surface by the lower wall part 33, and the front-back side surfaces by the side wall part 34. The standing member 13 is reinforced by the intermediate wall part 35. The standing member 13 has the upper side from the upper surface of the intermediate wall part 35 formed as the cover part 13*a*, and the lower side as the leg part 13*b*.

Figure 4:
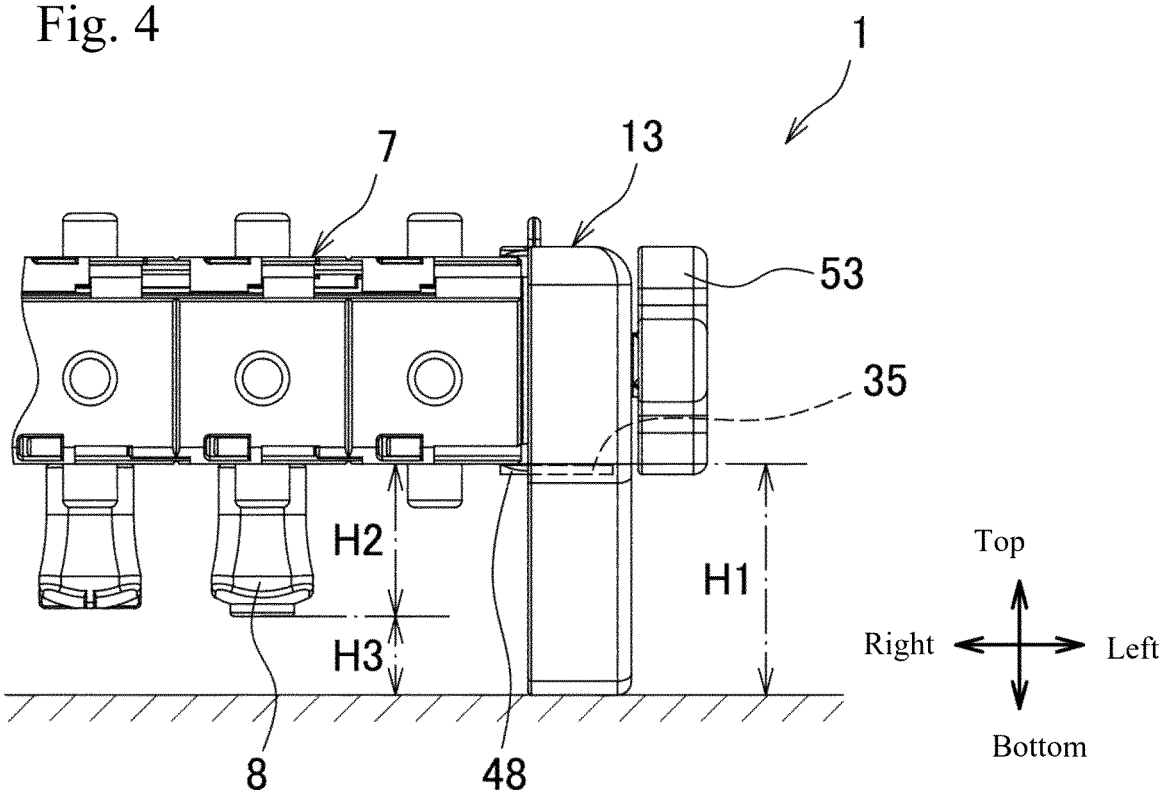
FIG. 4 is a partial front view of the game equipment 1 viewed from the front side in the front-back direction.

Referring to FIG. 4, this shows a partial front view of the game equipment 1 when viewed from the front side in the front-back direction. In the standing member 13, the height from the upper surface of the intermediate wall part 35 to the lower surface of the lower wall part 33 (specifically, the height of the leg part 13*b*) is H1. Preferably, the height H1 of the leg part 13*b* is 30 mm or greater and 35 mm or less. Here, with the height of the game piece 8 as H2, the height H1 of the leg part 13*b* is higher than the height H2 of the game piece 8. Preferably, the height H2 of the game piece 8 is 18 mm or greater and 25 mm or less, for example. A subtraction height H3 with the height H2 of the game piece 8 subtracted from the height H1 of the leg part 13*b* is lower than the height H2 of the game piece 8. Specifically, the standing member 13 is formed so that the height H1 of the leg part 13*b* is higher than the height H2 of the game piece 8 and less than twice the height H2 of the game piece 8. Preferably, the height H1 of the leg part 13*b* is 1.2 times or greater and 1.9 times or less than the height H2 of the game piece 8.

Returning to FIG. 3, formed on the standing member 13 are a first support unit 41, a second support unit 42, a third support unit 43, and a fourth support unit 44 as well as a first plate part (first projecting part) 46, a second plate part (second projecting part) 47, and a third plate part (third projecting part) 48. The first support unit 41 is a cylindrical support unit extending in the lateral direction formed at approximately the center in the front-back direction of the standing member 13. This first support unit 41 is a circular cylinder with an inner diameter that is the same as the outer diameter of the first pin 21 of the base member 11 and that has a bottom on the design wall part 31 side. The first support unit 41 has a horizontal surface 41*a* formed corresponding to the horizontal surface 23 of the first pin 21. The second support unit 42 is a cylindrical support unit extending in the lateral direction formed at a position corresponding to the second pin 22 of the base member 11. This second support unit 42 is a circular cylinder with an inner diameter the same as the outer diameter of the second pin 22 of the base member 11, and that has a bottom on the design wall part 31 side. The second support unit 42 has a through hole corresponding to the female thread part 24 formed on the bottom. Specifically, the through hole is formed penetrating the design wall part 31 in the lateral direction.

The third support unit 43 is a cylindrical support unit extending leftward from the design wall part 31. This third support unit 43 is a circular cylinder that has a bottom on the design wall part 31 side. The third support unit 43 is reinforced by a reinforcement wall part 43*a* extending radially in the vertical direction and the lateral direction, for example. The fourth support unit 44 has a cylindrical support column 44*a* extending leftward from the design wall part 31. The support column 44*a* is a rectangular column for which the outline has a square cross section shape. The support column 44*a* is formed with a through hole 44*c* that penetrates the design wall part 31 and extends in the lateral direction inside. Compared to the third support unit 43, this support column 44*a* does not have a wall part such as the reinforcing wall part 43*a* in the vertical direction and the front-back direction. Said another way, the fourth support unit 44 has a space formed on the periphery of the support column 44*a*. Therefore, the fourth support unit 44 can have a resistance part 5*a* described later disposed in the space.

The first plate part 46 is a plate part extending facing the third support unit 43 or the support column 44*a* from a corner 37 which is the junction part of the upper wall part 32 and the side wall part 34 and a T-shaped part 38 which is the junction part of the side wall part 34 and the intermediate wall part 35. The second plate part 47 is a plate part extending facing upward from the left end of the upper side of the third support unit 43 and the fourth support unit 44 in the upper wall part 32. The third plate part 48 is a plate part extending facing leftward from the left end of the center in the front-back direction of the upper wall part 32 and the intermediate wall part 35. This third plate part 48 has an inclined part 48*a* formed extending outward in the vertical direction as it moves outward in the front-back direction. Said another way, the inclined part 48*a* is formed on the third plate part 48 to move away from the track belt unit 7 as it moves outward in the front-back direction when viewed in the vertical direction.

According to FIG. 2, the drive units 5 drive the track belt unit 7 by rotating around an axis in the lateral direction by manual operation by the user. The drive units 5 are positioned as a front-back pair in the front and back of the base member 11. This drive unit 5 has a rotating member 51 and a handle 53. The drive member 5 has a click member 55 and a spring 57 as a resistance part 5*a* that gives a sense of resistance to the drive, as well as a recess 63, described later, of the rotating member 51. Hereafter, mainly the drive unit 5 on the front side in the front-back direction is described, and the drive unit 5 on the back side in the front-back direction has the same form in the present embodiment, and is rotated 180° around an axis in the vertical direction, so a detailed explanation is omitted.

The rotating member 51 is a rectangular column-shaped member made of resin positioned forward of the base member 11 and extending in the lateral direction. This rotating member 51 has a drive part 61, a rotating shaft 62, and the recess 63. The drive part 61 is formed to have a square-shaped cross section in a rectangular solid shape extending in the lateral direction. Specifically, the drive part 61 has four side surfaces 61*c* formed following the same rectangle shape in the front-back direction and the vertical direction. In the drive part 61, the upper side is open in the orientation shown in FIG. 2, opening the interior space. The drive part 61 is reinforced by a reinforcement part 61*a* parallel to the surface along which the space extends in the front-back direction and the vertical direction. Furthermore, the drive part 61 is formed with a groove part 61*b* extending along the corners corresponding to the four sides (long sides) extending in the lateral direction when viewed as a rectangular solid.

The rotating shaft 62 is a cylinder extending outward in the lateral direction from the left end surface (sliding surface 61*d*) and the right end surface of the drive part 61. Of this rotating shaft 62, a flat plane 62*a* and a female thread part 62*b* are formed on the rotating shaft 62 extending leftward. The flat plane 62*a* is a flat plane-shaped notch formed on the left end upper part of the rotating shaft 62. The female thread part 62*b* is a female thread formed extending to the right from the left end of the rotating shaft 62. The recesses 63 are formed aligned in the circumferential direction of the rotating shaft 62 on the left end surface of the drive part 61. In the present embodiment, four recesses 63 are arranged at equal intervals when viewed in the circumferential direction of the rotating shaft 62.

The handle 53 is a knob made of resin that has for example four grip parts extending in the radial direction with respect to the axial direction of the rotating shaft 62. This handle 53 is positioned at the left side of the standing member 13. The handle 53 has a cylindrical support unit 53*a* formed extending to the right from the center of the front-back direction and the vertical direction of the left side surface. The support unit 53*a* has a circular cylinder shape for which the inner diameter is the same as the outer diameter of the rotating shaft 62. The support unit 53*a* has a flat plane 53*b* corresponding to the flat plane 62*a* on the inside.

The click member 55 included in the resistance part 5*a* is a disk-shaped resin member disposed between the rotating member 51 and the standing member 13. According to FIG. 3, the click member 55 has an energizing part 65, a sliding part 66, a rectangular column hole 67, and a convex part 68. Hereafter, for convenience of explanation, when explaining the click member 55 following FIG. 3, an example is explained of the click member 55 at the back side in the front-back direction. As described above, the click member 55 at the front side in the front-back direction is an item for which the click member 55 at the back side of the front-back direction is rotated 180° around the vertical direction as the axis.

The energizing part 65 included in the resistance part 5*a* is a disk-shaped flat plate part extending in the radial direction around the lateral direction as the axis. This energizing part 65 has an outer diameter larger than the outer diameter of the spring 57. The sliding part 66 is a cylindrical-shaped pillar part extending to the right from the center of the energizing part 65. This sliding part 66 has an outer diameter that is smaller than the inner diameter of the spring 57. The rectangular column hole 67 is a hole that penetrates from the center of the energizing part 65 and the sliding part 66 in the lateral direction. This rectangular column hole 67 has an approximately square-shaped cross section corresponding to the outline of the support column 44*a* in the fourth support unit 44 of the standing member 13. The convex part 68 is a hemispherical convex part that projects to the left from the left end surface of the energizing part 65. In the present embodiment, the same as with the recesses 63 formed on the drive part 61 of the rotating member 51, the four convex parts 68 are arranged at equal intervals when viewed in the circumferential direction from the center of the energizing part 65. Specifically, the convex parts 68 are formed at positions corresponding to the recesses 63 formed on the drive part 61 of the rotating member 51.

Returning to FIG. 2, the spring 57 is a coil spring that energizes in the lateral direction. This spring 57 is disposed between the standing member 13 and the click member 55. In specific terms, the spring 57, while covering the outer periphery in the radial direction of the sliding part 66 of the click member 55, has the right end in contact with the energizing part 65. The spring 57 has the left end in contact with a support surface 44*b* of the fourth support unit 44 in the standing member 13 (see FIG. 3).

The track belt unit 7 is a so-called endless track formed in a belt and ring shape. This track belt unit 7 has an upper part 7*a* extending in the front-back direction, a lower part 7*b* positioned below the upper part 7*a* and extending in the front-back direction, and a side part 7*c* that extends downward from both ends in the front-back direction of the upper part 7*a* and is connected to both ends in the front-back direction of the lower part 7*b*. The track belt unit 7 covers the upper side, the front side, the lower side, and the back side of the support unit 3 and the drive unit 5. The track belt unit 7 is configured by a plurality (16, for example) of flat plate-shaped track plate members 70 that are members made of resin and that extend in the lateral direction.

Figure 5:
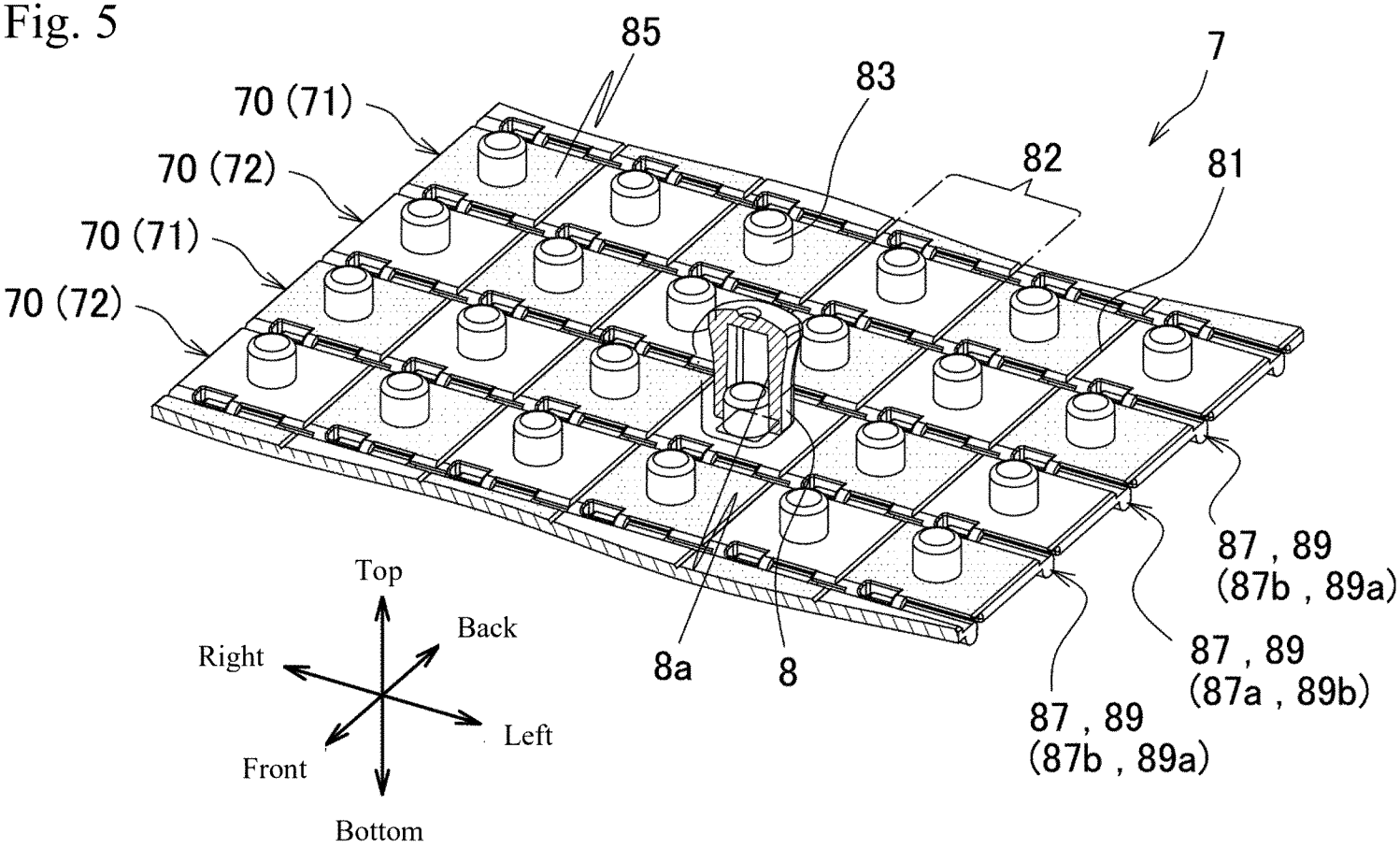
FIG. 5 is a perspective view of the upper part of a track belt unit 7.

Referring to FIG. 5, shown is a perspective view of the upper part of the track belt unit 7. The track plate member 70 includes a partitioning groove 81, a square 82, a locking pin (holding part) 83, a rough surface 85, a shaft part 87, and a bearing part 89. The partitioning groove 81 is a groove that is formed on the upper surface (also called the front surface) of the track plate member 70 and extends in the front-back direction. This partitioning groove 81 is a groove for partitioning the surface of the track plate member 70 evenly in the lateral direction. Specifically, a plurality (in the present embodiment, six) of squares (placement squares) 82 partitioned by the partitioning groove 81 are formed on the front surface of the track plate member 70.

The locking pin 83 is a pin extending upward from the center of the square 82. This locking pin 83 can lock with the locked part 8*a* formed on the game piece 8 (shown in vertical cross section for explaining in FIG. 4). Here, the game piece 8 is a member made of resin that is flexible and contains, for example, ethylene-vinyl acetate (EVA). This game piece 8 is formed in approximately a rectangular solid shape, for example. The game piece 8 has the locked part 8*a* formed. The locked part 8*a* is a recess extending facing the interior from a square-shaped (polygonal) opening formed on one end of the game piece 8, for example.

Therefore, the game piece 8 has a vacant space when the locked part 8*a* is locked with the cylinder-shaped locking pin 83, so it is possible to adjust the frictional force between the locking pin 83 and the locked part 8*a*, and to suppress fluctuation of the air pressure inside the locked part 8*a* when the locking pin 83 is locked with the locked part 8*a*. Therefore, even if the locking pin 83 is in an orientation extending facing the front-back direction and downward in the vertical direction by driving of the track belt unit 7, the game piece 8 is held suitably by the locking pin 83 and can be removed from the locking pin 83 by the user of the game equipment 1. Furthermore, the game piece 8 contains a flexible material such as EVA, so it is possible to broaden the contact area between the locking pin 83 and the locked part 8*a* when locking with the locking pin 83. A portion of the game piece s 8 among the plurality of game pieces 8 have a projection formed on a head part 8*b* of the upper side in the vertical direction as shown in FIG. 1. The projection of the head part 8*b* shows the type of game piece 8. Specifically, there are the same number of shapes for the head part 8*b* as there are types of the game pieces 8. This allows the user to recognize the type of the game piece 8 by touching the projection of the game piece 8.

Returning to FIG. 5, the rough surface 85 is a surface with a high surface roughness compared to other parts of the track plate member 70. This rough surface 85 is formed every other of the plurality of squares 82. Specifically, in the track plate member 70, the surface roughness changes every other square 82.

Figure 6:
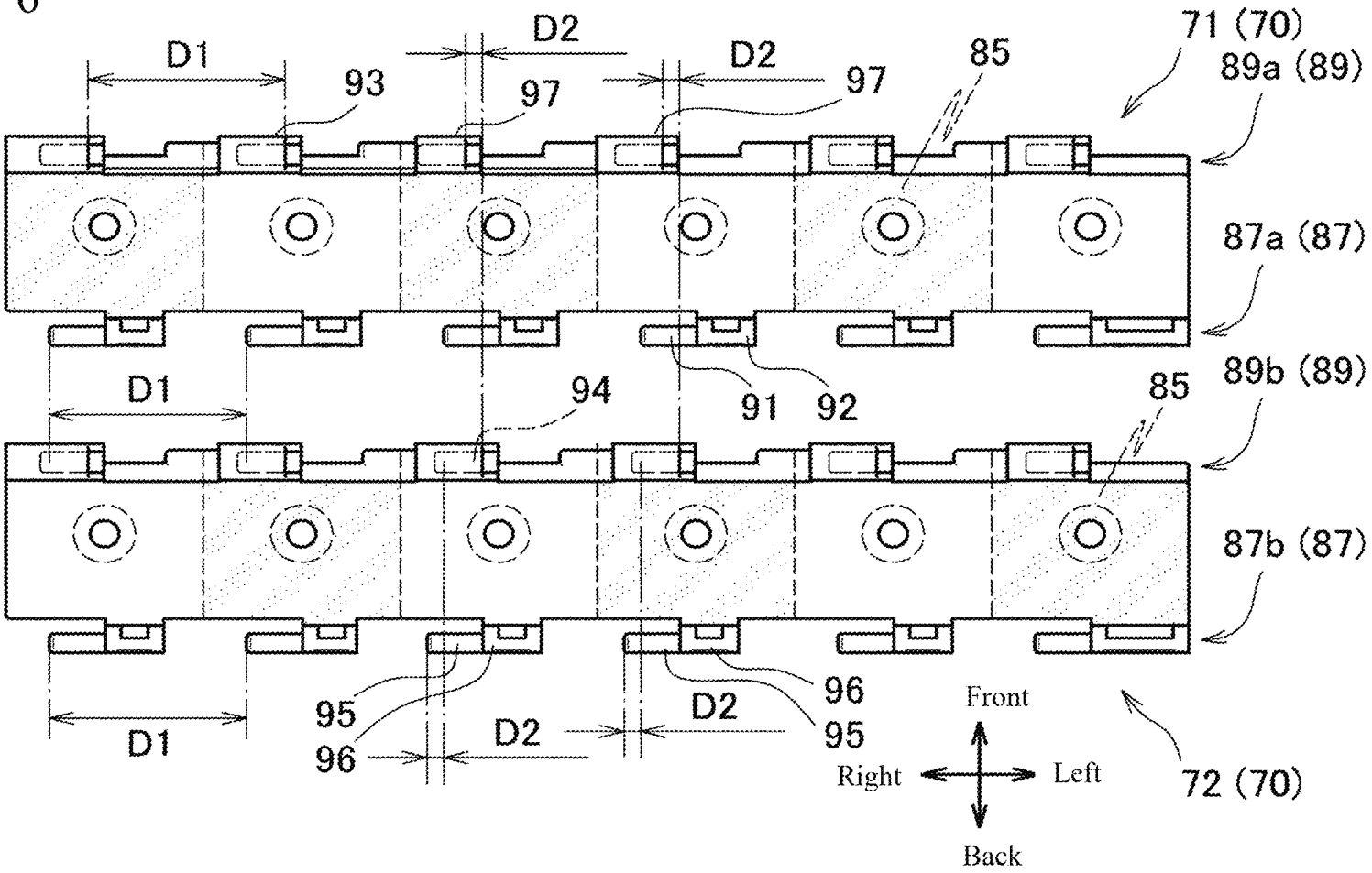
FIG. 6 is a bottom view of a first track plate member 71 and a second track plate 72 arranged side by side.

Referring to FIG. 6, shown is a drawing of the lower surface (also called the back surface) on which a first track plate member 71 and a second track plate member 72 are arranged side by side. The shaft part 87 is formed on the back side end part of the track plate member 70. This shaft part 87 includes a plurality of shaft pins 91 and pin support units 92. The shaft pin 91 is a pin that extends rightward from the pin support unit 92 extending to the rear from the back side part of the track plate member 70. The shaft pin 91 and the pin support unit 92 project downward when viewed from the lateral direction (see FIG. 5). The bearing part 89 is formed on the front side end part of the track plate member 70. This bearing part 89 includes a plurality of bearings 93. The bearings 93 project to the front from the front side part of the track plate member 70. This bearing 93 has a bearing hole 94 formed on the inside open to the left side and extending rightward. The bearing hole 94 is a hole with an inner diameter approximately equal to the outer diameter of the shaft pin 91. The bearing 93, the same as the shaft in 91 and the pin support unit 92, projects downward when viewed from the lateral direction (see FIG. 5).

Here, the plurality of track plate members 70 that constitute the track belt unit 7 are configured by two types, for example, the first track plate member 71 and the second track plate 72. The first track plate member 71 is formed so that in order from the right side in the lateral direction, the first, third, and fifth squares 82 have the rough surfaces 85. On the other hand, the second track plate member 72 is formed so that in order from the right side in the lateral direction, the surface roughness of the second, fourth, and sixth squares 82 have the rough surface 85. Specifically, the position of the rough surface 85 in the plurality of squares 82 differs between the first track plate member 71 and the second track plate member 72.

The position of at least a portion of the shaft pins 91 differs between the shaft part 87 of the first track plate member 71 and the shaft part 87 of the second track plate member 72. Similarly, the position of at least a portion of the bearings 93 differs between the bearing part 89 of the first track plate member 71 and the bearing part 89 of the second track plate member 72. Hereafter, the shaft part 87 and the bearing part 89 of the first track plate member 71 are called first shaft part 87*a* and first bearing part 89*a*, and the shaft part 87 and the bearing part 89 of the second track plate member 72 are called second shaft part 87*b* and second bearing part 89*b*.

On the first shaft part 87*a* of the first track plate member 71 a plurality (six in the present embodiment) of shaft pins 91 are formed separated from each other by a first distance D1. Similarly, on the second bearing part 89*b* of the second track plate member 72, the same number of bearings 93 as the shaft pins 91 of the first shaft part 87*a* are formed separated from each other by the first distance D1. Specifically, the plurality of shaft pins 91 on the first shaft part 87*a* of the first track plate member 71 are formed to have the same interval as the plurality of bearings 93 in the second bearing part 89*b* of the second track plate member 72. This makes it possible for the first track plate member 71 to have the shaft pins 91 of the first shaft part 87*a* to be inserted in bearing holes 94 of the bearings 93 of the second bearing part 89*b* in the second track plate member 72, and to be rotatably assembled to the second track plate member 72.

A plurality (six in the present embodiment) of bearings 93 are formed on the first bearing part 89*a* of the first track plate member 71, the same as with the second bearing part 89*b* of the second track plate member 72. On the other hand, in contrast to the second bearing part 89*b* of the second track plate member 72, the first bearing part 89*a* of the first track plate member 71 has at least one bearing 93 (in the present embodiment, the third and fourth bearings 93 from the right side in the lateral direction) formed at a position offset by a second distance D2 to the right side in the lateral direction. Hereafter, for convenience of explanation, the third and fourth bearings 93 in the first bearing part 89*a* are called specific bearings 97. On the second shaft part 87*b* of the second track plate member 72, a plurality of (six in the present embodiment) shaft pins 91 and pin support units 92 are formed the same as with the first shaft part 87*a* of the first track plate member 71. On the other hand, in contrast to the first shaft part 87*a* of the first track plate member 71, in the second shaft part 87*b* of the second track plate member 72, at least one set of shaft pins 91 and pin support units 92 (in the present embodiment, the third and fourth shaft pins 91 and pin support units 92 from the right side in the lateral direction) are formed at positions offset by the second distance D2 to the right side in the lateral direction. Hereafter, for convenience of explanation, the third and fourth shaft pins in the second shaft part 87*b* are called specific shaft pins 95, and the third and fourth pin support units in the second shaft part 87*b* are called specific pin support units 96.

Specifically, the shaft pins 91 and the pin support units 92 that include the specific shaft pins 95 and the specific pin support units 96 in the second shaft part 87*b* of the second track plate member 72 and the bearings 93 including the specific bearings 97 in the first bearing part 89*a* of the first track plate member 71 are formed at the same intervals. This makes it possible, in the second track plate member 72, to insert the shaft pins 91 in the second shaft part 87*b* into the bearing holes 94 of the bearings 93 of the first bearing part 89*a* in the first track plate member 71, and to rotatably assemble to the first track plate member 71.

Here, when assembling the first track plate member 71 to the front side of the second track plate member 72, all the shaft pins 91 of the first shaft part 87*a* are inserted in all the bearings 93 of the second bearing part 89*b* to be assembled. At this time, because all the shaft pins 91 and pin support units 92 are positioned at the same intervals as all the bearings 93, the right ends of all the pin support units 92 abut the corresponding left ends of all the bearings 93. As a result, when the first track plate member 71 is assembled to the front side of the second track plate member 72, both sides in the lateral direction match for the first track plate member 71 and the second track plate member 72. Similarly, when assembling the first track plate member 71 to the back side of the second track plate member 72, all of the shaft pins 91 that include the specific shaft pins 95 of the second shaft part 87*b* are inserted in all the bearings 93 that include the specific bearings 97 of the first bearing part 89*a* to be assembled. At this time, because all the shaft pins 91 and pin support units 92 are positioned at the same intervals as the bearings 93, the right end of all the pin support units 92 abut the left end of all the corresponding bearings 93. As a result, even when assembling the first track plate member 71 to the back side of the second track plate member 72, both sides in the lateral direction match for the first track plate member 71 and the second track plate member 72.

Figure 7:
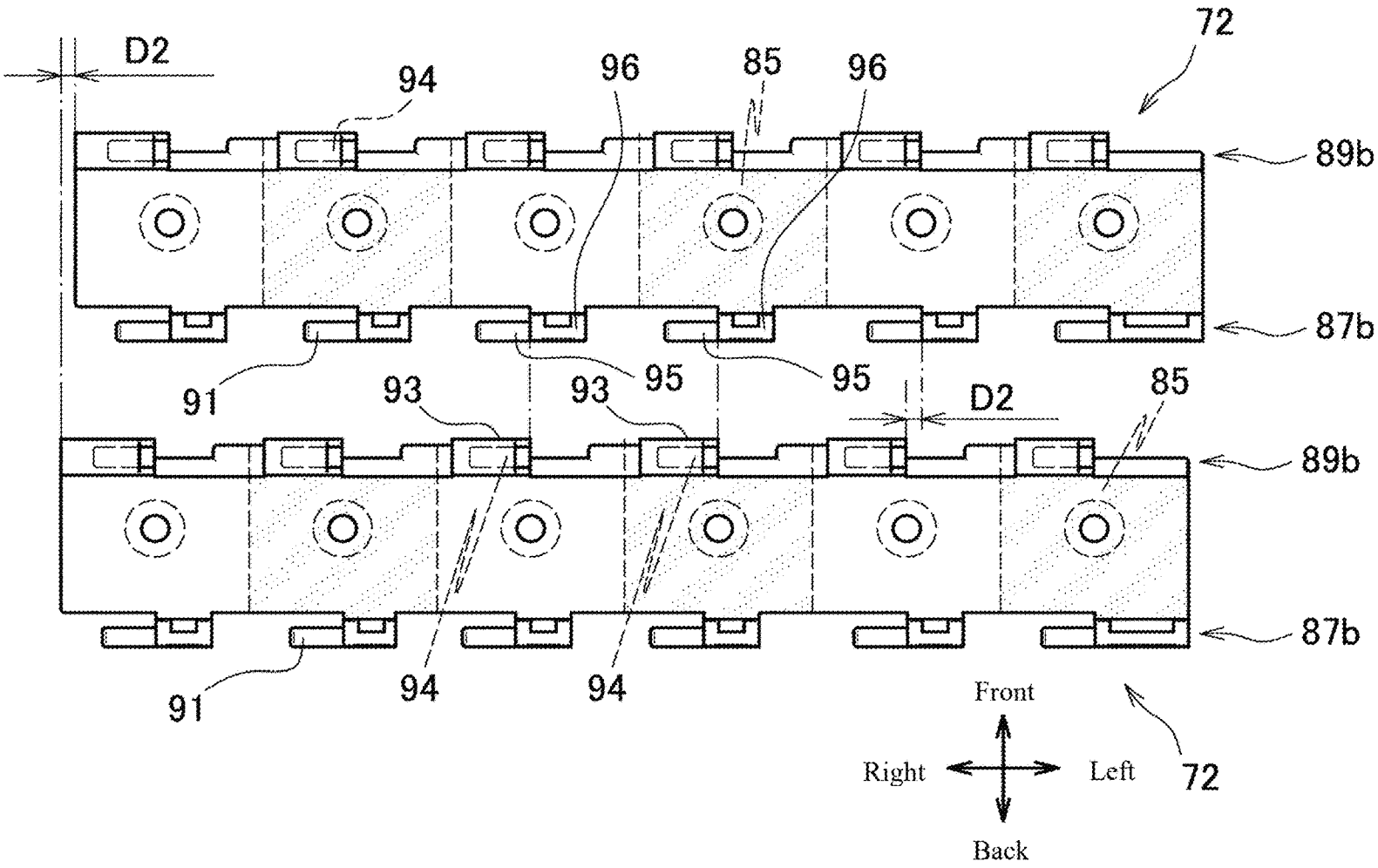
FIG. 7 is an explanatory drawing for explaining the corresponding relationship between a second shaft part 87*b* and a second bearing part 89*b* when attempting to assemble a second track plate member 72 to the second track plate member 72.

Referring to FIG. 7, this shows an explanatory drawing for explaining the corresponding relationship of the second shaft part 87*b* and the second bearing part 89*b* when an attempt is made to assemble the second track plate member 72 to the second track plate member 72. When an attempt is made to assemble the second track plate member 72 to the front side of the second track plate member 72, said another way, when an attempt is made to assemble second track plate members 72 to each other by accident, the specific shaft pins 95 of the second shaft part 87*b* in the second track plate member 72 on the front side in the front-back direction are inserted in the bearing holes 94 of the bearings 93 which are not the specific bearings 97 of the second bearing part 89*b* in the other second track plate member 72. When the specific shaft pins 95 are inserted in the bearing holes 94 of the bearings 93 in this way, the specific pin support units 96 abut the bearings 93. On the other hand, the pin support units 92 that are not the specific pin support units 96 are separated by the second distance D2 from the bearings 93. Specifically, when an accidental attempt is made to assemble second track plate members 72 to each other, only the specific pin support units 96 abut the bearings 93 without the pin support units 92 abutting the bearings 93. As a result, a relative skew of for example the second distance D2 occurs in the lateral direction between the two second track plate members 72.

Therefore, in the track belt unit 7, by providing the specific shaft pins 95 and the specific pin support units 96 of the second shaft part 87*b* in the second track plate member 72 at positions offset by the second distance D2 compared to the other shaft pins 91, when an accidental attempt is made to assemble second track plate members 72 to each other, it is possible to cause a relative skew in the lateral direction between the second track plate members 72. As a result, the track belt unit 7 can prevent so-called incorrect assembly of accidentally assembling second track plate members 72 to each other. In the track belt unit 7, the difference between the first track plate member 71 and the second track plate member 72 is the difference in positions of the shaft pins 91, the pin supports 92, and the bearings 93 in the bearings 93 and the bearing holes 94, so it is possible to maintain design properties and prevent incorrect assembly.

In the track belt unit 7, by the first track plate member 71 and the second track plate member 72 being assembled alternately, it is possible to configure so that the surface roughness of adjacent squares 82 in the front-back direction and the lateral direction have a mutually different surface roughness. In this way, the track belt unit 7 is configured so that the surface roughness of the adjacent squares 82 in the front-back direction and the lateral direction are different from each other, so even when a visually impaired person uses the game equipment 1, for example, it is possible to distinguish between the squares 82 by sense of touch. In particular, by preventing incorrect assembly such as assembling second track plate members 72 to each other as described above, it is possible to accurately assemble alternately the first track plate members 71 and the second track plate members 72 which are difficult to tell apart.

Next, based on FIGS. 2 and 3, an example of the assembly procedure of the game equipment 1 is explained. In the first step, the standing member 13 on the right side in the lateral direction is assembled to the base member 11. In specific terms, the standing member 13 has the first pin 21 of the base member 11 inserted in the first support unit 41 and the second pin 22 of the base member 11 inserted in the second support unit 42. At this time, the horizontal surface 23 is formed on the first pin 21 of the base member 11, so the standing member 13 is assembled with the horizontal surface 23 of the first pin 21 abutting the horizontal surface 41*a* of the first support unit 41. This makes it possible for the base member 11 to be assembled to the standing member 13 in the correct orientation without being inverted vertically. After that, the standing member 13 has the base member 11 secured by the second pin 22 and the second support unit 42 being screwed together by screws 9.

In the second step, the standing member 13 has the drive unit 5 on the back side in the front-back direction assembled to the fourth support unit 44. Specifically, first, with the click member 55, the support column 44*a* of the fourth support unit 44 is inserted in the rectangular column hole 67. At this time, the spring 57 is inserted in the sliding part 66 of the click member 55, and is disposed so as to be sandwiched by the energizing part 65 and the support surface 44*b* of the fourth support unit 44. Next, the rotating member 51, while pressing against the spring 57 to the right in the lateral direction, inserts the rotating shaft 62 in the through hole 44*c* of the support column 44*a* in the fourth support unit 44 and makes the rotating shaft 62 project to the right side from the design wall part 31 of the standing member 13. Next, with the handle 53, the support unit 53*a* is inserted in the rotating shaft 62 of the rotating member 51 from the right side in the lateral direction of the standing member 13. The handle 53 is secured to the rotating member 51 by screwing the screws 9 in the female thread part 62*b* of the rotating shaft 62 in the rotating member 51. Here, as described above, on the support unit 53*a* of the handle 53, the flat plane 53*b* corresponding to the flat plane 62*a* of the rotating shaft 62 is formed. Specifically, the handle 53 is secured to the rotating shaft 62 by abutting the flat plane 53*b* of the support unit 53*a* and the flat plane 62*a* of the rotating shaft 62. This makes it possible for the flat plane 62*a* and the flat plane 53*b* to prevent relative rotation of the handle 53 with respect to the rotating member 51.

In the third step, the standing member 13 has the rotating member 51 of the drive unit 5 disposed on the third support unit 43 on the front side in the front-back direction. In specific terms, the standing member 13 has the rotating shaft 62 of the rotating member 51 inserted in the third support unit 43.

In the fourth step, the track belt unit 7 is disposed to cover the front and back and top and bottom of the base member 11 and the rotating member 51. In specific terms, the track belt unit 7 is formed in a ring shape with the first track plate members 71 and the second track plate members 72 joined together alternately in advance, for example. The track belt unit 7 formed in a ring shape in advance in this way is moved to the right from the left side in the lateral direction of the base member 11 and the rotating member 51 so as to cover the base member 11 and the rotating member 51. The track belt unit 7 moved to the right in the lateral direction has the right end abut the standing member 13. At this time, the track belt unit 7 has the track plate members 70 of the upper side and the lower side positioned between the third plate part 48 and the base member 11.

In the fifth step, the standing member 13 as well as the handle 53, the click member 55, and the spring 57 are assembled to the left side in the lateral direction of the base member 11 and the rotating member 51. In specific terms, first, the standing member 13 inserts the support column 44*a* of the fourth support unit 4 into the rectangular column hole 67 of the click member 55 so as to sandwich the spring 57. At this time, the track belt unit 7 has the track plate members 70 of the upper side and the lower side positioned between the third plate part 48 and the base member 11. Next, the standing member 13 has the first pin 21 and the second pin 22 of the base member 11 as well as the rotating shaft 62 of the rotating members 51 on both sides in the front-back direction respectively inserted in the first support unit 41, the second support unit 42, the third support unit 43, and the fourth support unit 44. Next, the standing member 13 is secured to the base member 11 by having the second pin 22 and the second support unit 42 screwed together by screws 9. Then, the handle 53 is secured to the rotating member 51 by the screws 9 being screwed into the female thread part 62*b* of the rotating shaft 62 in the rotating member 51. By assembling in this way, the game equipment 1 can be assembled efficiently with relatively little work, so it is possible to reduce the manufacturing expense related to assembly, for example.

Figure 8:
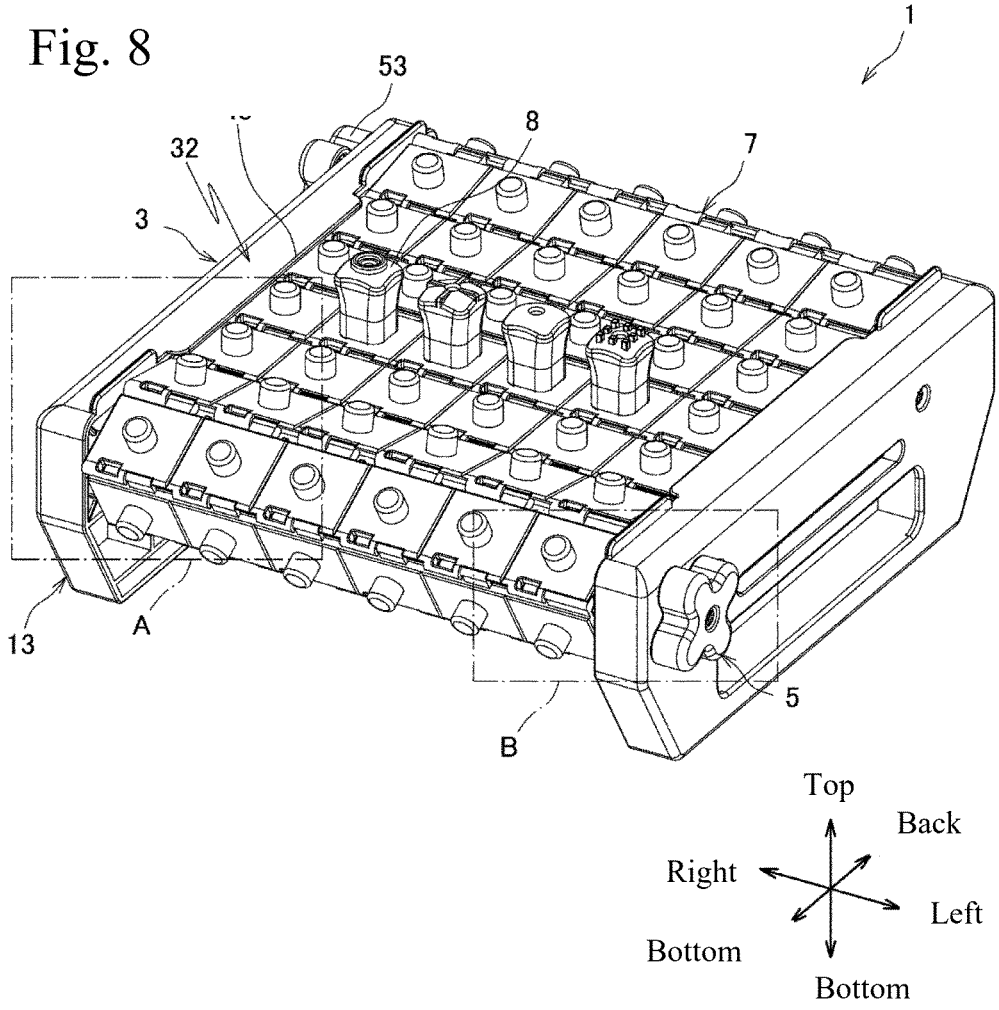
FIG. 8 is a perspective view of the game equipment 1 in a state with the track belt unit 7 driven by the drive unit 5.
Figure 9:
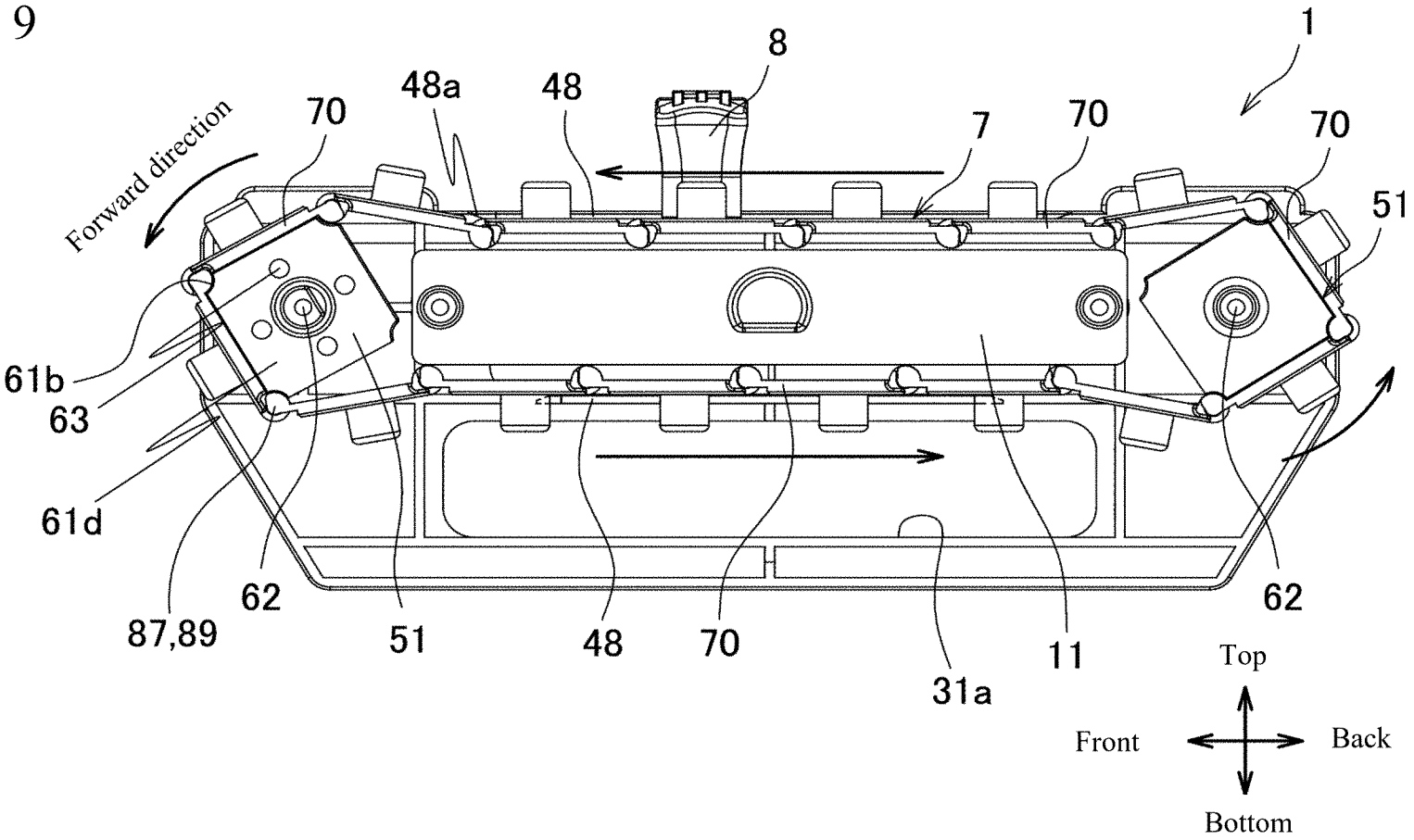
FIG. 9 is a side view when the game equipment 1 is in a state with the track belt unit 7 driven by the drive unit 5 when viewed from the left side in the lateral direction.

Referring to FIG. 8, shown is a perspective view of the game equipment 1 in a state with the track belt unit 7 driven by the drive unit 5. Referring to FIG. 9, shown is a side view of the game equipment 1 in a state with the track belt unit 7 driven by the drive unit 5 when viewed from the left side in the lateral direction. The game equipment 1 in FIG. 9 does not show the standing member 13 in the left side of the lateral direction, as well as the handle 53, the click member 55, and the spring 57.

In the game equipment 1, when the user rotates at least one of the two handles 53 around an axis in the lateral direction, the track belt unit 7 is driven. In specific terms, when the handle 53 is rotated around an axis in the lateral direction, the rotating member 51 also rotates around an axis in the lateral direction in conjunction with the handle 53. According to FIG. 9, for example when the rotating member 51 on the front side in the front-back direction is driven to rotate in the counterclockwise direction when viewed from the left side in the lateral direction, the track plate member 70 that contacts the rotating member 51 on the front side in the front-back direction rotates in conjunction with the rotating member 51. The track plate member 70 positioned on the upper side of the base member 11 is pulled by the track plate member 70 rotating in conjunction with the rotating member 51 on the front side in the front-back direction and is moved forward in the front-back direction.

The track plate member 70 in contact with the rotating member 51 on the back side in the front-back direction is pulled by the track plate member 70 moving to the front in the front-back direction. At this time, the track plate member 70 in contact with the rotating member 51 on the back side in the front-back direction rotates in conjunction with the rotating member 51 because the rotating member 51 can rotate around the rotating shaft 62. The track plate member 70 positioned on the lower side of the base member 11 is pulled by the track plate member 70 rotating in conjunction with the rotating member 51 on the back side in the front-back direction and moves backward in the front-back direction. The track plate member 70 in contact with the rotating member 51 at the front side in the front-back direction is pulled backward by the track plate member 70 moving backward in the front-back direction.

Therefore, by the handle 53 being driven by the user, drive unit 5 can move the track plate members 70 like a so-called endless track and drive the track belt unit 7. In particular, by the groove part 61*b* being formed, the rotating member 51 can lock with the shaft part 87 and the bearing part 89 of the track plate members 70 and work in conjunction. By the track belt unit 7 being driven by the drive unit 5, the game piece 8 can move in the front-back direction and the vertical direction together with the track plate member 70 it is attached to.

Here, as described above, the third plate part 48 is formed on the upper wall part 32 of the standing member 13. The third plate part 48 is positioned on the upper side of the track plate member 70 positioned on the upper side of the base member 11. Specifically, the track plate member 70 positioned on the upper side of the base member 11 has movement in the vertical direction restricted by the base member 11 and the third plate part 48. This makes it possible for the base member 11 and the third plate part 48 to suppress the track plate member 70 positioned on the upper side of the base member 11 from rotating in the vertical direction when driving the track belt unit 7. Similarly, the track plate member 70 positioned on the lower side of the base member 11 has movement in the vertical direction restricted by the base member 11 and the third plate part 48, so it is possible to suppress rotation in the vertical direction when driving the track belt unit 7. By the inclined part 48*a* being formed on the third plate part 48, it is possible to appropriately guide the track plate member 70 to move outward in the front-back direction and outward in the vertical direction when driving the track belt unit 7.

Referring to FIG. 10, this shows an enlarged view of area A in FIG. 8. When driving the track belt unit 7, for example if the rotating member 51 is rotated counterclockwise by 30° (hereafter, this kind of rotation direction is called forward rotation) when viewed from the left around an axis in the lateral direction with the side surface 61*c* being in a perpendicular or a horizontal state (hereafter also called a static state), there are cases when the inner corner side of the corner 37 formed by the upper wall part 32 and the side wall part 34 is open (open part K1 in FIG. 10). At this time, the same as with the T-shaped part 38 which is the junction part of the side wall part 34 and the intermediate wall part 35, there are cases when the inner corner side facing the third support unit 43 is open (open part K2 in FIG. 10). On the other hand, as described above, the first plate part 46 extending facing the third support unit 43 or the support column 44*a* from the corner 37 and the T-shaped part 38 is formed on the standing member 13.

Therefore, by the first plate part 46 being formed on the standing member 13, in this kind of case as well, it is possible to reduce the opening area of the open parts K1, K2. Therefore, the first plate part 46 can suppress the user's fingers, etc., from entering the open parts K1, K2.

For example if the rotating member 51 rotates 30° in the forward direction from the static state, there are cases when the shaft part 87 and the bearing part 89 which are the junction part of the two track plate members 70 near each of the third support unit 43 and the fourth support unit 44 are positioned above the upper surface of the upper wall part 32. In this kind of case, viewed from the lateral direction, there are cases when a gap positioned above the upper surface of the upper wall part 32 is formed at the inner corner side of the two track plate members 70. On the other hand, as described above, the second plate part 47 extending facing upward from the left end of the upper side of the third support unit 43 and the fourth support unit 44 in the upper wall part 32 is formed on the standing member 13. Therefore, by the second plate part 47 being formed on the standing member 13, even in this kind of case, it is possible for the gap to be covered by the second plate part 47. Therefore, the second plate part 47 can suppress the fingers, etc., of the user from entering the gap.

Referring to FIG. 11, this shows an enlarged view of area B in FIG. 8. This FIG. 11 shows the standing member 13, the handle 53, the click member 55, and the spring 57 in a cross section broken at the vertical and lateral plane that includes the rotation axis center of the rotating member 51.

In the resistance part 5*a* of the drive unit 5, the click member 55 is energized by the spring 57 to the right in the lateral direction. When the recess 63 and the convex part 68 of the rotating member 51 are separated in the circumferential direction of the rotating shaft 62, the convex part 68 abuts the sliding surface 61*d* of the rotating member 51. Specifically, when the rotating member 51 is in an orientation rotated 30° in the forward direction from the static state, the convex part 68 abuts the sliding surface 61*d*. From this kind of state, when the rotating member 51 is rotated a further 60° in the forward direction, the convex part 68 is relatively closer to the recess 63 of the rotating member 51 when viewed in the circumferential direction of the rotating shaft 62. When the rotating member 51 ends rotation by 60° in the forward direction, the convex part 68 fits loosely in the recess 63. Specifically, when the rotating member 51 is in a static state, the click member 55 is energized to the right in the lateral direction by the spring 57, and the convex part 68 is in a state fit loosely in the recess 63.

On the other hand, when the rotating member 51 is rotated in the forward direction when in the static state, the click member 55 moves to the left in the lateral direction. In specific terms, to get out of the state with the convex part 68 fit loosely in the recess 63, the click member 55 moves to the left in the lateral direction by the amount of the height of the lateral direction of the convex part 68. As a result, for the rotating member 51 to rotate in the forward direction when in a static state, it is necessary to go against the energizing force of the spring 57 that energizes the click member 55 to the right in the lateral direction, and to move the click member 55 to the left in the lateral direction. Said another way, when the rotating member 51 rotates from the static state, the resistance part 5*a* of the drive unit 5 resists the drive force that drives the rotating member 51 around the rotating shaft 62 as the axis. Therefore, the user who is rotating the handle 53 can determine whether the rotating member 51 is in the static state based on the sense of resistance (clicking sense) due to rotational resistance when rotating the handle 53. Therefore, the user can easily put the rotating member 51 in the static state when rotating the handle 53. Thus, the game equipment 1 can keep the square 82 on the upper side of the track belt unit 7 precisely horizontal.

Figure 12:
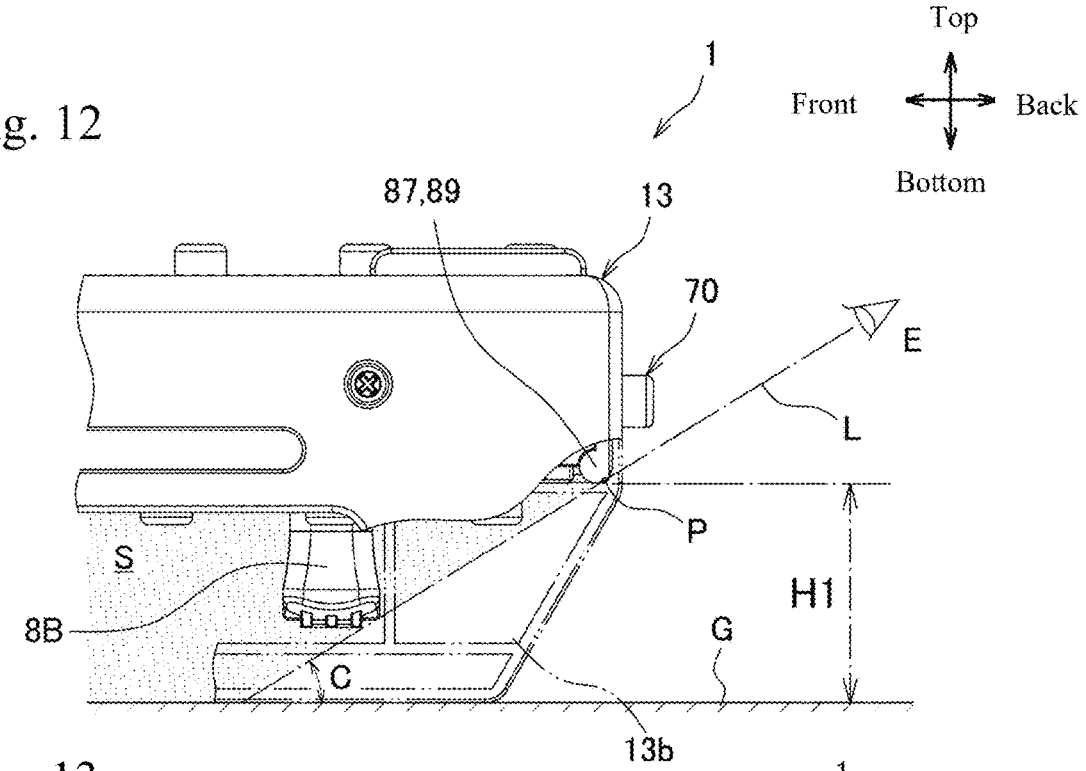
FIG. 12 is an explanatory drawing for explaining the positional relationship between a game piece 8 positioned in area S and the game equipment 1 when viewed from the left side in the lateral direction.
Figure 13:
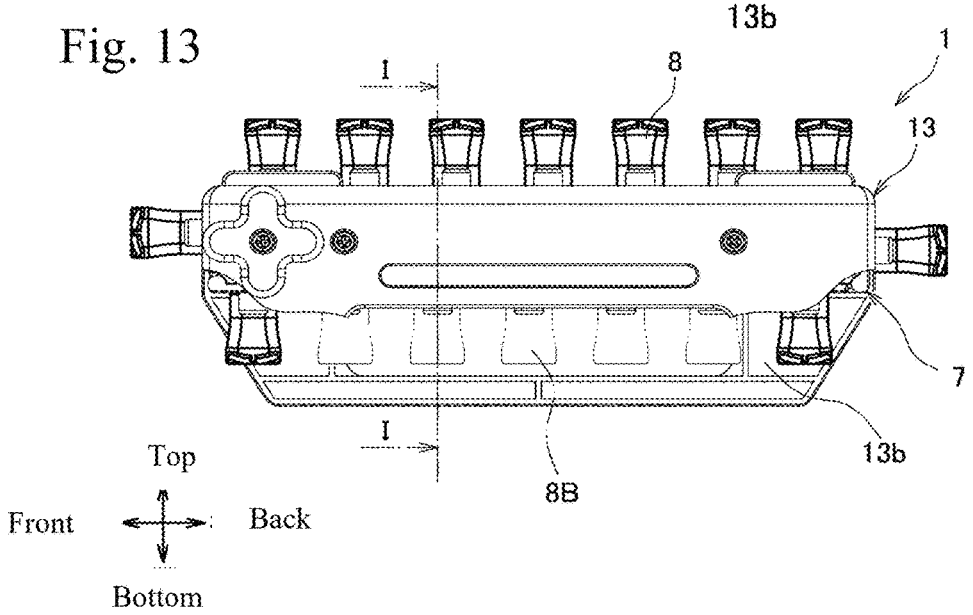
FIG. 13 is an explanatory drawing for explaining the visibility of the game piece 8 positioned in area S when viewed from the left side in the lateral direction.

Referring to FIG. 12, shown is an explanatory drawing for explaining the positional relationship between the game piece 8 positioned in the area S and the game equipment 1 when viewed from the left in the lateral direction. Also, referring to FIG. 13, shown is an explanatory drawing for explaining the visibility of the game piece 8 positioned in the area S when viewed from the left in the lateral direction. Hereafter, for convenience of explanation, the game piece 8 positioned in a square among the plurality of squares 82 positioned at the lower side of the track belt unit 7 other than the square 82 of the track plate member 70 positioned at the front-back end or the left-right end is called invisible game piece 8B.

According to FIG. 13, the track belt unit 7 is supported by the support unit 3 as described above. The support unit 3 has a base member 11 and a left-right pair of standing members 13 that support the track belt unit 7 as described above. Furthermore, the base member 11 has the leg part 13*b* of height H1 formed as described above. Specifically, the lower part in the vertical direction and the front and back in the front-back direction of the track belt unit 7 are open. As a result, even with the game piece 8 positioned at the lower side of the track belt unit 7, the support unit 3 allows the user to visually recognize the game piece 8 attached to the locking pin 83 of the square 82 of the track plate member 70 positioned at the front-back ends or the left-right ends.

On the other hand, the game equipment 1 suppresses the invisible game piece 8B from being visually recognized by the user. In specific terms, when viewed from the left side in the lateral direction, the invisible game piece 8B is positioned in the area S on the outside corner side when the angle of the inner corner C formed by a straight line L, extending from end point P on the lower side in the vertical direction which is the back in the front-back direction of the shaft part 87 or the bearing part 89 in the track plate member 70 formed on the back side in the front-back direction of the track belt unit 7 to the ground surface G, and the ground surface G is an angle of θ or less. Therefore, the game equipment 1 can suppress the invisible game piece 8B from being visibly recognized by the user by positioning the invisible game piece 8B in the area S.

Figure 14:
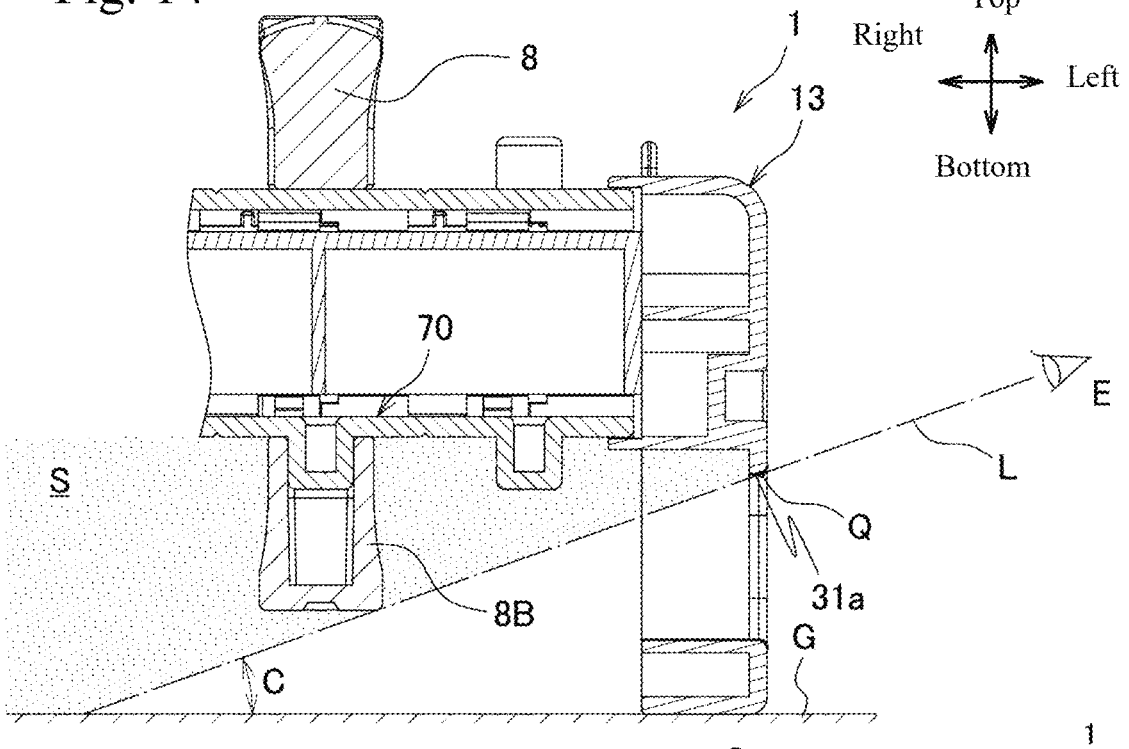
FIG. 14 is an I-I cross section in FIG. 14, and an explanatory drawing for explaining the positional relationship between the game piece 8 positioned in the area S and the game equipment 1.
Figure 15:
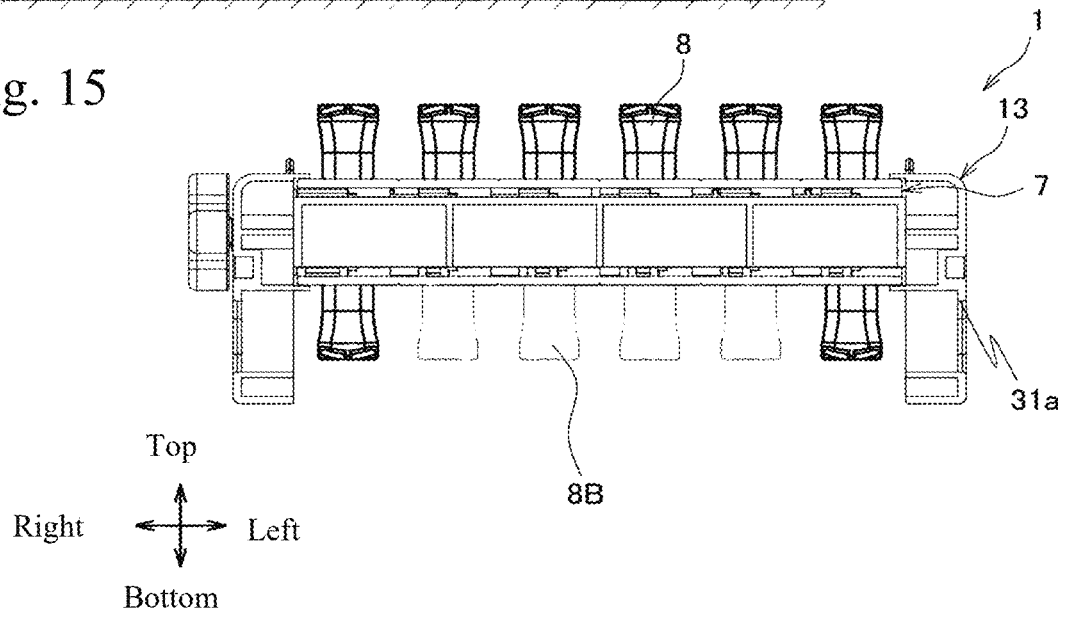
FIG. 15 is an explanatory drawing for explaining the visibility of the game piece 8 positioned in the area S when viewed from the front in the front-back direction.

Referring to FIG. 14, shown is an explanatory drawing that is the I-I cross section in FIG. 13 and is for explaining the positional relationship between the game piece 8 positioned in the area S and the game equipment 1. Referring to FIG. 15, shown is an explanatory drawing for explaining the visibility of the game piece 8 positioned in the area S when viewed from the front in the front-back direction. As described above, the design wall part 31 has the horizontal hole 31*a* formed extending in the front-back direction below the center of the vertical direction. As a result, the game equipment 1 can allow the user to visually recognize the game piece 8 attached to the locking pin 83 of the square 82 near the horizontal hole 31*a* even in the case of the game piece 8 positioned below the track belt unit 7.

On the other hand, the game equipment 1 suppresses the invisible game piece 8B from being visually recognized by the user. In specific terms, when viewed from the front in the front-back direction, the invisible game piece 8B is positioned in the area S of the outside corner when the angle of the inner corner C formed by the straight line L, which extends from the end point Q on the left side in the lateral direction of the top edge of the horizontal hole 31*a* formed on the design wall part 31 to the ground surface G, and the ground surface G is angle θ or less. Therefore, by positioning the invisible game piece 8B in the area S, the game equipment 1 can suppress the invisible game piece 8B from being visible recognized by the user.

Here, the angle θ of the inner corner C described above is the angle of the inner corner C formed by the straight line L, drawn between the user start point E and the invisible game piece 8B without being obstructed by the track plate member 70 and the standing member 13, etc., and the ground surface G, when the user visually recognizes the ground surface G below the track belt unit 7. Preferably, the angle θ is 45° or less. More preferably, the angle θ is 30° or less. The height H1 of the leg part 13*b* is preferably 100 mm or less. More preferably, the height H1 of the leg part 13*b* is 35 mm or less.

Therefore, by having the angle of the inner corner C formed by the straight line L and the ground surface G be angle θ or less, it is possible to suppress the user from visually recognizing the invisible game piece 8B when using the game equipment 1. By having the angle θ be 45° or less, the bisector of the angle formed by the upper part and the side part of the track belt unit 7 and the straight line L coincide, so when the user visually recognizes the game pieces 8 held at the upper part and the side part of the track belt unit 7, it is possible to suitably suppress the invisible game piece 8B from being reflected in the field of view. In particular, by making the angle θ 30° or less, when attempting to visually recognize the invisible game piece 8B, the user's posture is affected, so it is possible for another user, etc., to confirm that the user is intentionally trying to visually recognize the invisible game piece 8B. By having the height H1 of the leg part 13*b* be 100 mm or less, said another way, by having it be approximately equal to or less than the vertical length from the chin to the eye of the average person, it is possible to suppress the invisible game piece 8B from being visually recognized by the user even if the user is in a posture with his or her chin on the ground surface G. Furthermore, by having the height H1 of the leg part 13*b* be 35 mm or less, said another way, by having it be approximately equal to or less than the average horizontal length from temple to eye, it is possible to suppress the user from visually recognizing the invisible game piece 8B even if the user is in a posture with his or her temple placed on the ground surface G.

As described above, according to FIG. 4, by having the height H1 of the leg part 13*b* be higher than the height H2 of the game piece 8 and be less than twice the height H2 of the game piece 8, while preventing the game piece 8 from abutting the ground surface G, it is possible to suppress an increase in the possibility of the user visually recognizing the invisible game piece 8B due to the height H1 of the leg part 13*b* being made unnecessarily high. Furthermore, by having the height H1 of the leg part 13*b* be 1.2 times to 1.9 times the height H2 of the game piece 8, while suitably preventing the game piece 8 from abutting the ground surface G, it is possible to suitably suppress an increase in the possibility of the user visually recognizing the invisible game piece 8B due to the height H1 of the leg part 13*b* from being unnecessarily high, and further possible to lower the center of the gravity of the game equipment 1.

As explained above, in the game equipment according to the present invention, comprised are: a track belt unit 7 that has an upper part 7*a* and a lower part 7*b* extending in the front-back direction, that is formed in a ring shape, and in which by being driven, at least a portion of the upper part 7*a* is moved in one direction in the front-back direction to move to the lower part 7*b* and at least a portion of the lower part 7*b* is moved in the other direction in the front-back direction to move to the upper part 7*a*; a drive unit 5 that drives the track belt unit 7; and a support unit 3 in which the lower wall part 33 of the standing member 13 is grounded, and supports the track belt unit 7 separated by the height H1 from the ground surface G. In the track belt unit 7, a plurality of the squares 82 showing the placement location of the game pieces 8 are formed in the front-back direction and the lateral direction on the upper part 7*a* and the lower part 7*b*. The squares 82 have the locking pin 83 as the holding part that holds the game piece 8, and when positioning on the upper part 7*a* and the lower part 7*b*, the locking pin 83 holds the game piece 8.

As a result, in the game equipment 1 according to the present invention, by having the track belt unit 7, on which squares 82 having a holding part that hold the game piece 8 are formed, supported separated by the height H1 from the ground surface G by the support unit 3, driven by the drive unit 5, it is possible to move the game piece 8 being held on the track belt unit 7 downward while maintaining the hold. Therefore, the game equipment 1 according to the present invention can provide to the user a game in which the game pieces 8 are held above and below the track belt unit 7.

In the game equipment 1 according to the present invention, the track belt unit 7 has the side part 7*c* that extends downward from both sides in the front-back direction of the upper part 7*a*, and is connected to both sides in the front-back direction of the lower part 7*b*. In the squares 82 positioned on the side part 7*c*, the locking pin 83 holds the game piece 8. This makes it possible for the track belt unit 7 to hold the game piece 8 even on the side part 7*c*.

In the game equipment 1 according to the present invention, the track belt unit 7 has a plurality of flat plate-shaped track plate members 70 having a plurality of the squares 82 formed in the lateral direction. This makes it possible for the track belt unit 7 to maintain the surface of the squares 82 as a flat plane. By a plurality of the squares 82 being formed in the lateral direction on the flat plate-shaped track plate member 70, it is possible to suitably maintain the relative position between adjacent squares 82 in the lateral direction. Furthermore, in the game equipment according to the present invention, the track belt unit 7 is formed in a ring shape connected to be able to rotate the plurality of track plate members 70. As a result, the track belt unit 7 can be formed in a ring shape that allows the plurality of track plate members 70 to change orientation flexibly by rotating relatively to each other. Therefore, the track belt unit 7 is configured only by the plurality of track plate members 70, making it possible to increase manufacturability and also be driven in endless track form.

Furthermore, in the game equipment according to the present invention, the track plate member 70 has a shaft part 87 connected to one track plate member 70 among two connected track plate members 70 and a bearing part 89 connected to the other track plate member 70, with a shaft pin 91 extending in the lateral direction formed on the shaft part 87, and the bearing 93 that supports the shaft pin 91 to be able to rotate formed on the bearing part 89. As a result, in the track belt unit 7, by the shaft pin 91 extending in the lateral direction formed on the shaft part 87 of the one track plate member 70 being supported to be able to rotate by the bearing 93 of the bearing part 89 in the other track plate member 70, it is possible to support the track plate members 70 to be able to rotate relative to each other around the lateral direction as the axis while using a simple structure.

In particular, in the game equipment according to the present invention, the track belt unit 7 has the first track plate member 71 and the second track plate member 72 at least a portion of which differs from the first track plate member 71, with the first shaft part 87*a* of the first track plate member 71 configured to be able to connect to the second bearing part 89*b* of the second track plate member 72, the second shaft part 87*b* of the second track plate member 72 configured to be able to connect to the first bearing part 89*a* of the first track plate member 71, and the first shaft part 87*a* having at least a portion that is different from the second shaft part 87*b*. As a result, in the track belt unit 7, it is possible to specify the first bearing part 89*a* and the second bearing part 89*b* to be connected according to the difference between the first shaft part 87*a* and the second shaft part 87*b*. Therefore, in the track belt unit 7, it is possible to prevent so-called incorrect assembly in which the first track plate member 71 and the second track plate member 72 are assembled in the wrong order when connecting the plurality of track plate members 70.

In specific terms, a prescribed number of shaft pins 91 (six in the present embodiment) are formed on the first shaft part 87*a* and the second shaft part 87*b*, a prescribed number of bearing parts 89 (six in the present embodiment) are formed on the first bearing part 89*a* and the second bearing part 89*b*, the shaft pins 91 formed on the second shaft part 87*b* have at least one (four in the present embodiment) formed at the same position in which the shaft pin 91 is formed on the first shaft part 87*a*, and at least one (two specific shaft pins 95 in the present embodiment) is formed at a different position from the shaft pin 91 formed on the first shaft part 87*a*. This makes it possible for the track belt unit 7 to prevent incorrect assembly while maintaining the design properties.

In the game equipment according to the present invention, the drive unit 5 has at least a portion positioned between the upper part 7*a* and the lower part 7*b* of the track belt unit 7, and has the rotating member 51 that rotates around the lateral direction as the axis. The rotating member 51 has the drive part 61 that extends in the lateral direction, in which the four surfaces that form the side surfaces 61*c* are formed in a rectangular solid of the same shape. In the drive part 61, one of the four side surfaces 61*c* supports the upper part 7*a* of the track belt unit 7. As a result, by the upper part 7*a* of the track belt unit 7 being supported by the side surface 61*c* of the drive part 61, the drive unit 5 is able to maintain the flatness of the upper part 7*a* of the track belt unit 7 while driving the track belt unit 7.

In the game equipment according to the present invention, the drive unit 5 has a resistance part 5*a* that resists the drive force that rotates the rotating member 51 around the lateral direction as the axis, and the resistance part 5*a* resists the drive force when the side surface of the side surfaces 61*c* of the drive part 61 that supports the upper part 7*a* of the track belt unit 7 is tilted from the horizontal state. As a result, by resisting the drive force when the side surface 61*c* is tilted from the horizontal state using the resistance part 5*a*, the drive unit 5 is able to give a sense of resistance to the user who applies drive force to the handle 53 to rotate the rotating member 51, for example. Thus, since the drive unit 5 resists the drive force when the side surface 61*c* is tilted from the horizontal state using the resistance part 5*a*, it is possible to suitably maintain the flatness of the upper part 7*a* of the track belt unit 7.

In the game equipment according to the present invention, the support unit 3 has the standing member 13 that is positioned near both ends in the lateral direction sides of the track belt unit 7, and covers both ends when viewed from the lateral direction, and the standing member 13 includes the upper wall part 32 formed along the upper part 7*a* of the track belt unit 7, the side wall part 34 extending downward in the vertical direction from the end in the front-back direction of the upper wall part 32, and the first plate part 46 that extends toward the inner corner from the corner 37 formed by the upper wall part 32 and the side wall part 34. As a result, by the support unit 3 including the first plate part 46 extending toward the inner corner from the corner 37 formed by the upper wall part 32 and the side wall part 34, at least a portion of the inner corner side of the corner 37 opened when the track belt unit 7 is driven is closed by the first plate part 46. Thus, the first plate part 46 can suppress entry of foreign matter, etc., to the inner corner side of the opened corner 37.

In the game equipment according to the present invention, the support unit 3 has a cover member positioned near both ends at the lateral direction sides of the track belt unit 7, and covers both ends when viewed from the lateral direction, and the standing member 13 includes the upper wall part 32 formed along the upper part 7*a* of the track belt unit 7, and the second plate part 47 extending upward from the end part of the track belt unit 7 side of the upper wall part 32. As a result, by the support unit 3 including the second plate part 47 extending upward from the end part of the track belt unit 7 side of the upper wall part 32, even if a portion of the upper part 7*a* of the second plate part 47 near the second plate part 47 moves upward from the upper wall part 32 when the track belt unit 7 is driven, it is possible to cover a portion of the track belt unit 7 when viewed from the lateral direction. Thus, the second plate part 47 can suppress entry of foreign matter, etc., on the lower side of a portion of the track belt unit 7.

In the game equipment according to the present invention, the support unit 3 has the third plate part 48 positioned at the upper side in the center of the front-back direction of the track belt unit 7. This makes it possible for the support unit 3 to suppress movement of the upper part 7*a* of the track belt unit 7 upward when the track belt unit 7 is driven.

In the game equipment according to the present invention, the locking pin 83 as the holding part that holds the game piece 8 includes the locking pin 83 that extends in the perpendicular direction from the square 82. The game piece 8 has a flexible locked part 8*a* that is locked with the locking pin 83. As a result, the track belt unit 7 can suitably hold the game piece 8 by the game piece 8 on which the flexible locked part 8*a* is formed being locked by the locking pin 83.

In particular, in the game equipment according to the present invention, the locked part 8*a* includes a recess in which the locking pin 83 is locked, and the recess has a polygonal opening. This makes it possible to form the recess to extend toward the interior of the game piece 8 from a square opening, for example, and to make a suitable contact area between the locking pin 83 and the locked part 8*a*.

Modification Examples

Above, an embodiment of the present invention was explained, but the present invention is not limited to that embodiment and various modifications are possible.

For example, in the present embodiment, the game equipment 1 was explained as comprising the support unit 3, the drive unit 5, and the track belt unit 7, but it is not necessary to comprise all of these, and some may also be integrated. The game equipment 1 may also be made to comprise items other than the support unit 3, the drive unit 5, and the track belt unit 7.

The support unit 3 was explained as an item having the base member 11 and a left-right pair of the standing member 13, but it is sufficient provided that it supports the drive unit 5 and the track belt unit 7, and is not limited to these configurations. For example, the base member 11 and the standing members 13 were explained as housing-shaped members made of resin, but they can also consist of a solid body made of wood or be constituted by combining pipes made of metal. The standing member 13 was explained as having the cover part 13*a* of the upper side and the leg part 13*b* of the lower side from approximately the center in the vertical direction, but may also be formed to be separate items. The standing member 13 was explained with the reinforcing wall part 43*a* extending radially in the vertical direction and the lateral direction from the third support unit 43 as well as the first plate part 46 extending toward the third support unit 43 from the corner 37 and the T-shaped part 38, but the invention is not limited to this, and for example, by abolishing the reinforcing wall part 43*a* and having the first plate part 46 extend so as to connect with the third support unit 43, while reinforcing the third support unit 43, it is possible to reduce the opening area of the open part on the inner corner side of the corner 37 and the inner corner side facing the third support unit 43 of the T-shaped part 38.

The drive unit 5 was explained positioned as a front-back pair at the front and back of the base member 11, but it is also possible to be either one of the front or back of the base member 11. In this case, regarding the other in relation to the one, it is acceptable to place only the rotating member 51 instead of the drive unit 5, and it is sufficient provided that the track plate members 70 are moved passively following when the track belt unit 7 is driven, and the track plate member 70 positioned at the upper side is supported. The rotating member 51 was explained as a member made of resin with the drive part 61 formed in a rectangular solid shape, but this can also be a triangular column and a hexagonal column. Furthermore, the rotating member 51 was explained as an item with a space open in the interior that is opened at the upper side in the orientation shown in FIG. 2, but it is also possible to block the open upper side with a flat plate, etc., or to configure as a solid body.

The resistance part 5*a* of the drive unit 5 was explained as an item having the click member 55, the spring 57, and the recess 63 of the rotating member 51, but the invention is not limited to this configuration, and it is also possible to have the user recognize the side surface 61*c* of the rotating member 51 as being in a static state (specifically, the track plate member 70 positioned on the upper side of the rotating member 51 being in a horizontal state). The drive unit 5 was explained as rotating around the lateral direction as the axis by manual operation by the user, but it is also possible to configure so that, for example, an electric motor, etc., is provided and rotation is done by the drive force of the electric motor. The drive unit 5 was constituted with the user rotating the handle 53, but, for example, it is also possible to constitute this by providing an operating button that the user presses in a straight line direction, in which the pressing force applied to the operating button in the straight line direction is converted to rotation direction force (drive force), and using this drive force to rotate the rotating member 51.

The track belt unit 7 was explained as an item constituted by a plurality of track plate members 70, but for example it is also possible to constitute this with a ring-shaped belt, and it is sufficient provided the game pieces 8 can be held on the upper side and the lower side of the track belt unit 7. Specifically, the track belt unit 7 may also have holding parts like the locking pins 83 formed projecting outward from the ring-shaped belt, or may be formed by having plate parts like the plurality of track plate members 70 adhered on the ring-shaped belt. The track plate member 70 was explained as an item in which the game pieces 8 are held by the locking pins 83 locking with the locked parts 8*a*, but it is also possible to form a recess similar to the locked part 8*a* on the track plate member 70, to form a pin similar to the locking pin 83 on the game piece 8, and it is sufficient provided the game pieces 8 are held. For example, the track plate member 70 may also be formed in a flat plane without forming the locking pin 83 on the square 82, and to provide a suction cup on the game piece 8, or to provide a surface fastener, a magnet, a snap button, etc., on the square 82 and the locking pin 83. The game piece 8 was explained as an item containing a material having flexibility such as EVA, but the entire game piece 8 does not have to be flexible, and it is sufficient provided the locked part 8*a* is flexible.

The track plate member 70 was explained as being configured so that the surface roughness of the adjacent squares 82 in the front-back direction and the lateral direction are differentiated by the rough surface 85, but it is also possible, for example, to change the sense of touch by the material, or to change the sense of touch by having a plurality of notch grooves on the front surface of the squares 82 have the direction in which the notch grooves extend differ in adjacent squares 82 in the front-back direction and the lateral direction, with it sufficient to be able to distinguish the squares 82 by the sense of touch. The track belt unit 7 was explained having the shaft part 87 and the bearing part 89 formed on the track plate member 70 to rotatably connect the track plate members 70 with each other, but for example it is also possible to use a member made of rubber and connect the track plate members 70 to each other, and it is sufficient provided it is possible for the track plate members 70 to be connected to be able to rotate relative to each other. In particular, the track plate member 70 was explained as having the specific shaft pin 95 and the specific pin support unit 96 of the second shaft part 87*b* in the second track plate member 72 provided at positions offset by the second distance D2 compared to the other shaft pin 91. However, the invention is not limited to this, and it is also possible to have the diameter of the specific shaft pin 95 be a different diameter from that of the other shaft pin 91, and it is sufficient provided it is possible to prevent incorrect assembly.

In the embodiment noted above, an example of the assembly procedure of the game equipment 1 was explained, but this is one example of the contents and order, etc., of these steps, and it is also possible to assemble using steps with different contents and order, etc. In specific terms, the fourth step was explained as having the track belt unit 7 formed in a ring shape with the first track plate members 71 and the second track plate members 72 joined alternately in advance being moved to the right from the left side in the lateral direction of the base member 11 and the rotating member 51 so as to cover the base member 11 and the rotating member 51. However, it is also possible to not form the track belt unit 7 in a ring shape in advance, and it may be formed in a ring shape while covering the front-back and top-bottom of the base member 11 and the rotating member 51 while alternately joining the first track plate members 71 and the second track plate members 72.

In the embodiment noted above, for each component, an example was explained of a constitutional material such as a member made of resin and EVA, etc., but these are examples, and it is also possible to use materials such as metal, wood, etc.

The names in the embodiment noted above are simply used to distinguish devices and configurations, etc., from each other, and it is acceptable to have other names according to the function of each device. In the present disclosure, even when "first," "second," etc., are noted, this does not mean that this is limited only to the two elements to which these are applied. It is of course also possible to include a plurality of elements of "third," "fourth," and more.

In the embodiment noted above, even when the explanation specifies a direction, the direction is specified for convenience of explanation, and it is not absolutely necessary to follow the directions used in the explanation. For example, in the embodiment noted above, an example was explained in which the rotating member 51 is rotated counterclockwise around the lateral direction as the axis when viewed from the left (rotating in the forward direction), but the same operating effect occurs in a case when the rotating member 51 rotates clockwise around the lateral direction as the axis when viewed from the left.

Effect of the Invention

According to a first aspect, by the game equipment using a drive unit to drive a track belt unit, which is supported by a support unit separated at a prescribed distance from the ground surface, and has squares formed that have a holding part for holding game pieces, it is possible to move the game piecess held on the track belt unit downward while remaining held in place. Therefore, the game equipment can provide users with a game in which the game pieces are held above and below the track belt unit.

According to a second aspect, the track belt unit can hold the game pieces even on the side part.

According to a third aspect, formation into a ring shape is possible while increasing manufacturability.

According to a fourth aspect, the track belt unit can support the track plate members to be able to rotate relative to each other around an axis in the lateral direction while using a simple structure.

According to a fifth aspect, the drive unit can prevent so-called incorrect assembly.

According to a sixth aspect, the drive unit can prevent so-called incorrect assembly.

According to a seventh aspect, the drive unit can maintain the flatness of the upper part of the track belt unit while driving the track belt unit.

According to the eighth means, the drive unit can maintain good flatness of the upper part of the track belt unit.

According to a ninth aspect, the first plate part can suppress foreign matter, etc., from entering the inner corner side of the corner that is opened when the track belt unit is driven.

According to a tenth aspect, the second plate part can suppress foreign matter, etc., from entering the underside of a portion of the upper part of the track belt unit near the second plate part.

According to a eleventh aspect, the support unit can suppress the upper part of the track belt unit from moving upward when the track belt unit is driven.

According to a twelfth aspect, the track belt unit can hold the game piece well by locking the game piece on which a flexible locked part is formed using the holding part.

According to a thirteenth aspect, it is possible to make a suitable contact area between a locking pin 83 and a locked part 8*a* by forming a recess to extend from a polygonal opening toward the interior of the game piece.

The abovementioned effects are merely illustrative examples for convenience of explanation, and do not limit the invention. In addition to the abovementioned effects, or instead of the abovementioned effects, any of the effects noted in the present disclosure or effects that would be clear to a person skilled in the art can be achieved.

What is claimed is:

1. A game equipment comprising:

a track belt unit being formed in a ring shape, the track belt unit extending in a longitudinal direction;

a drive unit being configured to rotate the track belt unit; and a support unit being configured to support the track belt unit, the track belt unit being wound around the support unit, the track belt unit being away from a floor by a prescribed distance, when the track belt unit is wound around the support unit, the longitudinal direction being parallel to a floor when the track belt unit is wound around the support unit, the track belt unit including first to third placement squares thereon, the first placement square being configured next to the second placement square in the longitudinal direction, the third placement square being configured next to the first placement square in a short direction perpendicular to the longitudinal direction, the first to third placement squares including respectively first to third holding parts being configured to hold respectively first to third game pieces, the track belt unit includes a plurality of first and second track plate members, and each one of the first and second track plate members having a plurality of placement squares formed in the short direction, and the first and second track plate members are connected to each other in the longitudinal direction with the ability to rotate together to form the ring shape of the track belt.

2. The game equipment according to claim 1, wherein the support unit includes first and second main surfaces being parallel to each other, and a first side connecting the first and second main surfaces, when the first placement square is on the first side, the first holding part is configured to hold the first game piece.

3. The game equipment according to claim 1, wherein the first track plate member includes a first shaft part, the second track plate includes a second bearing part, the first shaft part includes a first shaft pin extending in the short direction, and the first bearing part includes a first bearing that rotatably supports the shaft pin.

4. The game equipment according to claim 3, wherein the first track plate member is at least partially different from the second track plate member, the first shaft part is connected with the second bearing part, the first track plate member includes a first bearing part, the second track plate member includes a second shaft part being connected to the first bearing part, and the first shaft part is at least partially different from the second shaft part.

5. The game equipment according to claim 4, wherein the first shaft part includes a prescribed number of the shaft pins including the first shaft pin, the second shat part includes a prescribed number shaft pins including the second shaft pin, the first bearing parts includes a prescribed number of bearings including the first bearing, the second bearing parts includes a prescribed number of bearings including a second bearing, and the second shaft pin is formed at a same position as the first shaft pin, and at least one of the shaft pins of the second shaft part is formed at a different position from the shaft pins of the first shaft part.

6. The game equipment according to claim 1, wherein the drive unit has a rotating member, at least a portion of the rotating member is positioned in the ring shape of the track belt unit, the rotating member is configured to rotate around an axis extending in the short direction, the rotating member includes a drive part extending in the short direction, the drive part has a cube shape having four surfaces, and one of the four surfaces supports a part of the track belt unit being located on the first main surface being opposite to the second main surface, the second main surface is closer to the floor that the first main surface to the floor.

7. The game equipment according to claim 6, wherein the drive unit has a resistance part that resists a drive force that rotates the rotating member around the axis extending in the short direction, and the resistance part resists the drive force when the side surface supporting at least the part of the track belt unit tilts from a horizontal state.

8. The game equipment according to claim 1, wherein the support unit includes a cover member being configured at an end in the short direction of the track belt unit to cover the end, and the cover member includes an upper wall part, a side wall part, and a first projecting part, the upper wall part is formed along an upper-most part of the track belt unit, the side wall part extends downward in a vertical direction from at least a side end of the upper wall part in the longitudinal direction, and the first projecting part extends in an inner corner direction from a corner formed by the upper wall part and the side wall part.

9. The game equipment according to claim 8, wherein the cover member further includes a second projecting part that extends upward from an end of the upper wall part in the longitudinal direction on a side closer in the short direction to the track belt unit.

10. The game equipment according to claim 9, wherein the support unit has a third projecting part being configured on the upper side of the track belt unit in a center in the longitudinal direction.

11. The game equipment according to claim 1, wherein the holding part includes a locking pin extending in a direction perpendicular to the first placement square, the game pieces includes a locked part being configured to lock with the locking pin, and the locked part is elastic.

12. The game equipment according to claim 11, wherein the locked part includes a recess in which the locking pin is locked, and the recess opening is polygonal.

* * * * *